US007187342B2

(12) United States Patent
Heisen et al.

(10) Patent No.: US 7,187,342 B2
(45) Date of Patent: Mar. 6, 2007

(54) ANTENNA APPARATUS AND METHOD

(75) Inventors: Peter T Heisen, Kent, WA (US); Julio A Navarro, Kent, WA (US); Ming Chen, Kent, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 11/140,758

(22) Filed: May 31, 2005

(65) Prior Publication Data

US 2005/0219137 A1 Oct. 6, 2005

Related U.S. Application Data

(63) Continuation-in-part of application No. 10/917,151, filed on Aug. 12, 2004.

(60) Provisional application No. 60/532,156, filed on Dec. 23, 2003.

(51) Int. Cl.
*H01Q 21/00* (2006.01)

(52) U.S. Cl. ..... 343/853; 343/700 MS; 343/776

(58) Field of Classification Search ..... 343/771, 343/772, 776, 700 MS, 853
See application file for complete search history.

(56) References Cited

U.S. PATENT DOCUMENTS

| | | | | |
|---|---|---|---|---|
| 4,806,941 | A | 2/1989 | Knochel et al. | |
| 5,008,678 | A | 4/1991 | Herman | |
| 5,136,304 | A | 8/1992 | Peters | |
| 5,184,141 | A | 2/1993 | Connolly et al. | |
| 5,219,377 | A | 6/1993 | Poradish | |
| 5,276,455 | A | 1/1994 | Fitzsimmons et al. | |
| 5,488,380 | A | 1/1996 | Harvey et al. | |
| 5,675,345 | A | 10/1997 | Pozgay et al. | |
| 5,825,333 | A | 10/1998 | Kudoh et al. | |
| 5,886,671 | A | 3/1999 | Riemer et al. | |
| 6,018,659 | A | 1/2000 | Ayyagari et al. | |
| 6,424,313 | B1 | 7/2002 | Navarro et al. | |
| 6,429,816 | B1 * | 8/2002 | Whybrew et al. | 343/700 MS |
| 6,580,402 | B2 * | 6/2003 | Navarro et al. | 343/853 |
| 6,670,930 | B2 * | 12/2003 | Navarro | 343/776 |
| 6,768,471 | B2 * | 7/2004 | Bostwick et al. | 343/853 |
| 6,900,765 | B2 * | 5/2005 | Navarro et al. | 343/700 MS |
| 6,989,791 | B2 * | 1/2006 | Navarro et al. | 343/700 MS |
| 2004/0151876 | A1 | 8/2004 | Tanielian | |

OTHER PUBLICATIONS

Wallace, Jack; Redd, Harold; and Furlow, Robert; "Low Cost MMIC DBS Chip Sets for Phased Array Applications," IEEE, 1999, 4 pages.

* cited by examiner

*Primary Examiner*—Tho Phan
(74) *Attorney, Agent, or Firm*—Harness Dickey & Pierce P.L.C.

(57) ABSTRACT

A phased array antenna module for use in the gigahertz bandwidth. The module includes a metallic core with a pair of chip carrier assemblies secured to opposite sides of the core. The core has an internal waveguide with a signal splitter for directing electromagnetic wave energy evenly to the two chip carrier assemblies. A flexible, cylindrical connector assembly electrically couples the chip carrier assemblies to an aperture board. The aperture board includes a plurality of dipole antenna radiating elements. The module core is coupled directly to a cold plate. A direct thermal path is created between the chip carrier assemblies, the module core and the cold plate for highly efficient cooling of the electronic components on the chip carrier assemblies.

20 Claims, 16 Drawing Sheets

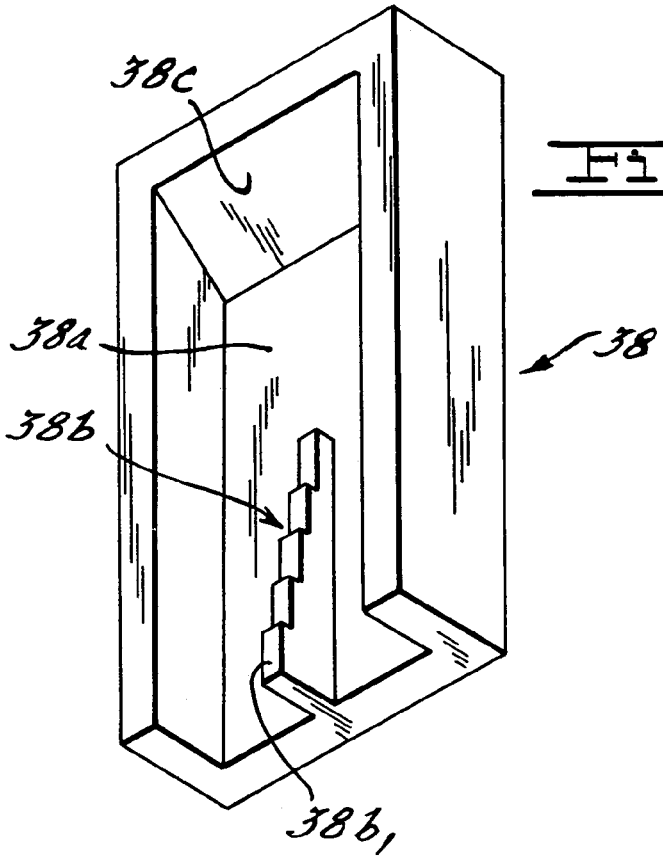
FIG. 4.
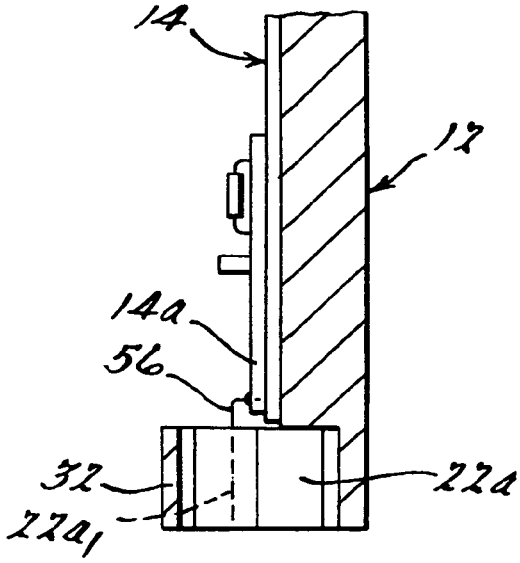
FIG. 6.
FIG. 5.
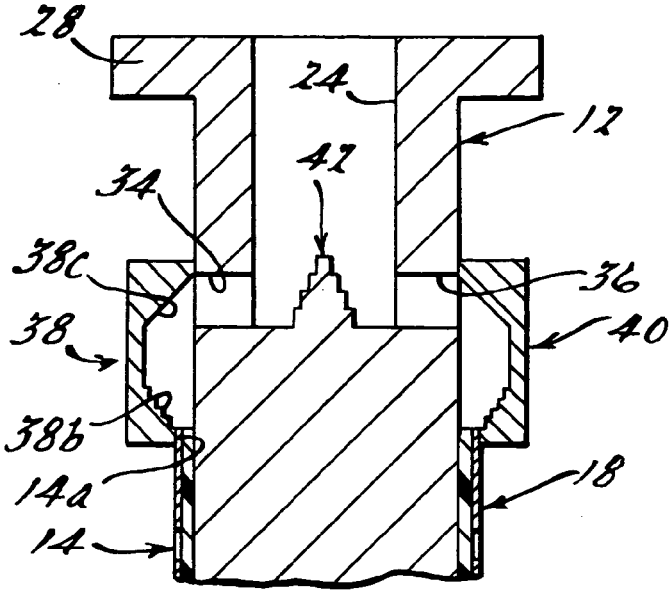

EM Wave Energy
257
258
254
254
256
257
240

281
274
276
278
277
280
246a

246a 2594
259

270
259
268a
268
287
262
264
284
266

287
261
274

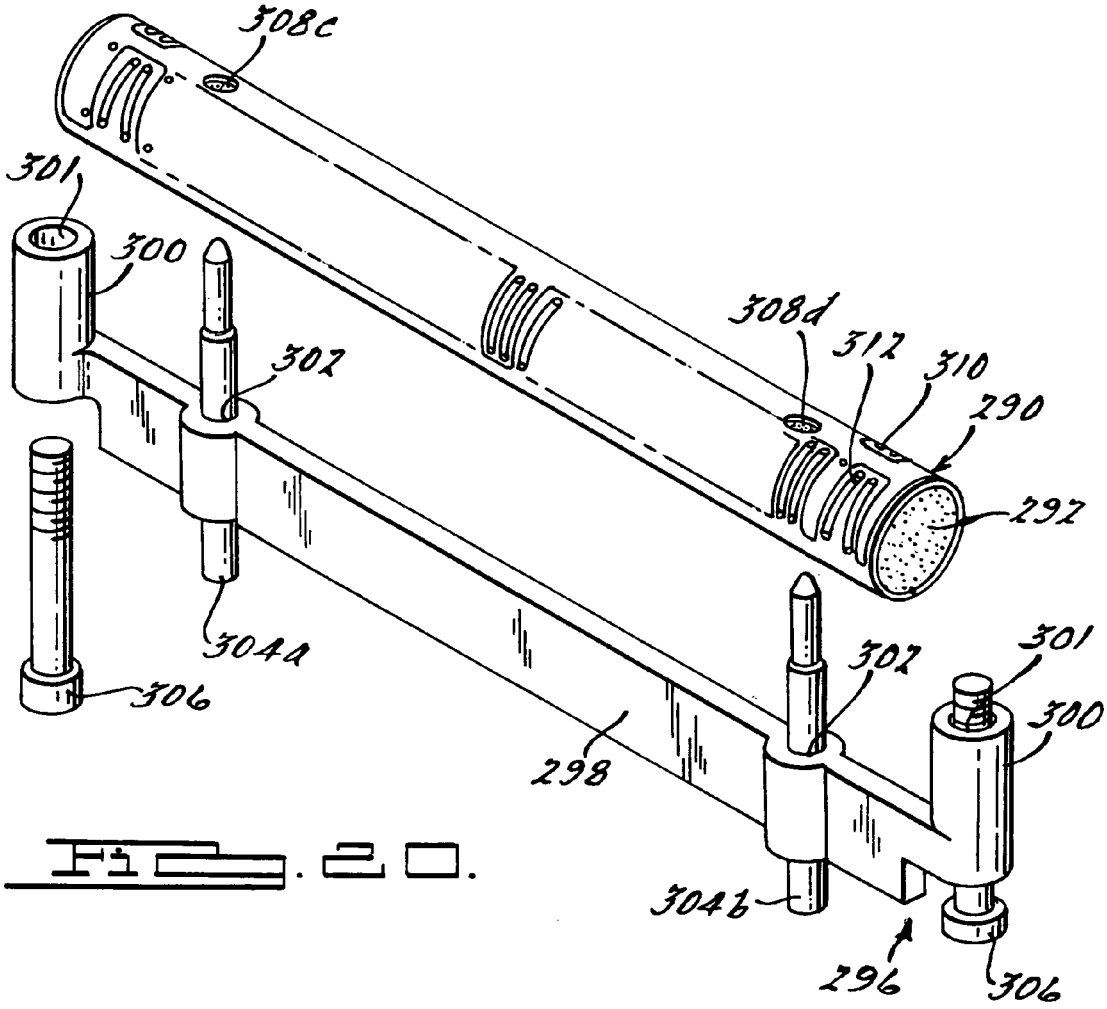
FIG. 20.
FIG. 22.
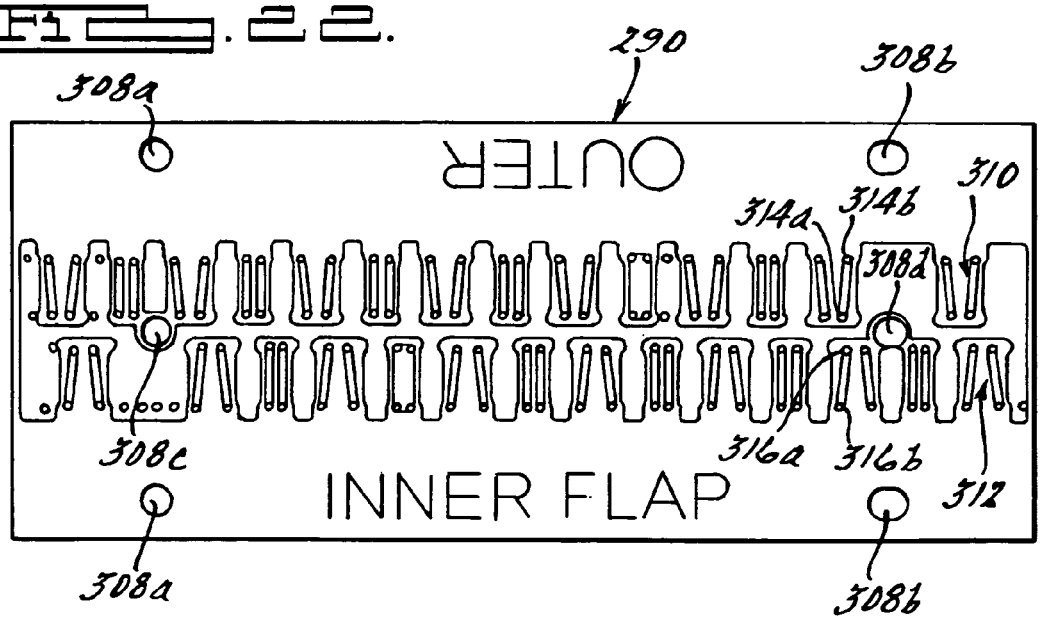

ANTENNA APPARATUS AND METHOD

CROSS-REFERENCE TO RELATED APPLICATIONS

This application is a continuation-in-part of U.S. Ser. No. 10/917,151 filed Aug. 12, 2004, presently pending, which claims priority from U.S. provisional application No. 60/532,156 filed on Dec. 23, 2003, the disclosures of which are incorporated herein by reference. The present application is also generally related to the subject matter of concurrently filed U.S. application Ser. No. 11/140,799, entitled "Electrical Connector Apparatus and Method".

STATEMENT OF GOVERNMENT RIGHTS

The subject matter of the present application was developed, at least in part, pursuant to Contract Number N00014-02-C-0068, granted by the Office of Naval Research. The U.S. Government has certain rights in this invention.

FIELD OF THE INVENTION

The present invention relates to antennas, and more particularly to a phased array antenna module preferably suitable for use in the gigahertz frequency band.

BACKGROUND OF THE INVENTION

The Boeing Company ("Boeing") has developed many high performance, low cost, compact phased array antenna modules. The antenna modules shown in FIGS. 1*a*–1*c* have been used in many military and commercial phased array antennas from S-band to Q-band. These modules are described in U.S. Pat. No. 5,886,671 to Riemer et. al. and U.S. Pat. No. 5,276,455 to Fitzsimmons et. al., both of which are incorporated by reference into the present application.

The in-line first generation module has been used in a brick-style phased-array architecture at K-band and Q-band. The approach shown in FIG. 1*a* requires elastomeric connectors for DC power, logic and RF distribution but it provides ample room for electronics. As implemented in FIG. 1*a*, the in-line module provides only a single beam, either linear or right-hand or left-hand circularly polarized. As Boeing phased array antenna module technology has matured, many efforts have resulted in reduced parts count, reduced complexity and reduced cost of several key components. Boeing has also enhanced the performance of the phased array antenna with multiple beams, wider instantaneous bandwidths and improved polarization flexibility.

The second generation module, shown in FIG. 1*b*, represents a significant improvement over the in-line module of FIG. 1*a* in terms of performance, complexity and cost. It is sometimes referred to as the "can-and-spring" design. This design provides dual orthogonal polarizations in a more compact, lower-profile package than the in-line module. The can-and-spring module forms the basis for several dual simultaneous beam phased arrays used in tile-type antenna architectures from S-band to K-band. The fabrication cost of the can-and-spring module has been reduced through the use of chemical etching, metal forming and injection molding technology. The third generation module developed by Boeing, shown in FIG. 1*c*, provides a low-cost dual polarization receive module used in high-volume production at Ku-band.

Each of the phased-array antenna module architectures shown in FIGS. 1*a*–1*c* require multiple module components and interconnects. In each module, a large number of vertical interconnects such as electrically conductive fuzz buttons and springs are used to provide compliant DC and RF connectivity between the distribution printed wiring board (PWB), ceramic chip carrier and antenna probes.

A further development directed to reducing the parts count and assembly complexity for single antenna modules is described by Navarro and Pietila in U.S. Pat. No. 6,580,402, assigned to Boeing. The subject matter of this application is also incorporated by reference into the present application and involves an "Antenna-integrated ceramic chip carrier" for phased array antenna systems, as shown in FIG. 1*d*. The antenna integrated ceramic chip carrier (AICC) module combines the antenna probes of the phased array module with the ceramic chip carrier that contains the module electronics into a single integrated ceramic component. The AICC module eliminates vertical interconnects between the ceramic chip carrier and antenna probes and takes advantage of the fine line accuracy and repeatability of multi-layer, co-fired ceramic technology. This metallization accuracy, multi-layer registration can produce a more repeatable, stable design over process variations. The use of mature ceramic technology also provides enhanced flexibility, layout and signal routing through the availability of stacked, blind and buried vias between internal layers, with no fundamental limit to the layer count in the ceramic stack-up of the module. The resulting AICC module has fewer independent components for assembly, improved dimensional precision and increased reliability. The in-line module, can-and-spring module, the molded module, and the AICC have been realized as single element modules. So far, the AICC has been implemented by Boeing as a single element phased array module which is connected to the printed wiring board and honeycomb in much the same way as the can-and-spring and injection-molded modules. The AICC approach provides manufacturing scalability from single to multiple elements. As manufacturing/assembly process yields increase, the AICC can be scaled from single to multiple element sub-arrays to reduce parts count and assembly complexity.

A Boeing antenna which departs from a single element module is described by Navarro, Pietila and Riemer in U.S. Pat. No. 6,424,313, also incorporated by reference into the present application, which is shown in FIG. 1*e*. This module is referred to within Boeing as the "3D flashcube". It has been implemented as a four-element module to provide additional space for electronics. This approach also avoids the use of fuzz buttons and button holders for its vertical interconnects. It has been used successfully to provide two independent simultaneous receive beams at 21 GHz with +/−60° scanning. It has also been implemented at 31 GHz in a switchable transmit application with +/−60° scanning. The 3D flashcube model can also be used to implement more than two independent receive and/or transmit beams.

In FIG. 1*f*, Boeing-Phantom Works further combines DC power, logic and the RF radiating probes into a phased array antenna into a single component through an approach known as the "Antenna Integrated Printed Wiring Board" ("AIPWB"). This approach is disclosed in U.S. Pat. No. 6,670,930, owned by Boeing, which is also incorporated by reference into the present application. This approach reduces parts count and further improves alignment and mechanical tolerances during manufacturing and assembly. The improved alignment and manufacturing tolerances improves yield and electrical performance while the reduced parts count shortens assembly time and reduces the number of processing steps required to manufacture the antenna module. This ultimately lowers the overall phased array antenna system costs. The AIPWB approach can be scaled to larger sub-arrays without degrading performance and represents an important step in the direction of more easily and affordably manufactured phased array antenna systems.

The first generation module in FIG. 1*a* is the standard single polarization in-line or brick architecture used extensively for many electronic phased array systems because of the ample room provided for electronics. FIGS. 1*b*, 1*c* and 1*d* use a tile-type or planar architecture which naturally provides dual polarization. A drawback of the tile architecture is that space is severely limited as frequency and scanning angle increases, since the electronics and input/output pads must fit within the physical area of the radiators in the array lattice. Because of the additional input and output pads required to connect to the RF/DC power/logic distribution, single element modules are further constrained in dimensions. As the array dimensions increase, the single element module pads require tighter dimensional tolerances to ensure alignment and connectivity.

The antenna module of FIG. 1*e* has some of the benefits of tile-type architectures, namely providing dual polarization and broad-side interconnections to the printed wiring board. It also has some of the benefits of the in-line architectures by providing ample area for electronics and transitions. The 3D flashcube concept has been realized as a quad-module but the approach can be increased to 2×N modules as yield in electronics and packaging increase. The 3D flashcube uses a three layer flexible stripline to provide connections from the electronics to the antennas as well as connections from the electronics to the printed wiring board.

However, even with the 3D flashcube implementation, it is difficult to provide the extremely tight antenna module spacing between adjacent antenna modules that is needed to achieve +/−60° scanning in the microwave frequency spectrum (e.g., 60 GHz). The limitation of using the three layer flexible stripline for interconnections is that as scan angles and frequencies increase, the stripline must be bent at very, very tight (i.e., small) bend radii in order to achieve the extremely close antenna module spacing required for +/−60° scan angle performance in the microwave frequency spectrum. The stripline ground plane and conductor line becomes more susceptible to breaking apart at the very small bend radii needed to accomplish this extremely tight radiating element spacing.

Accordingly, there still exists a need for a dual polarized, phased array antenna which is able to operate within the V-band frequency spectrum (generally between 40 GHz–75 GHz), and more preferably at 60 GHz, while preferably providing +/−60° (or better) grating-lobe free scanning. Such an antenna, however, requires a new packaging scheme for coupling the electronics of the antenna to the radiating elements in a manner to achieve the very tight radiating element spacing required for 60 GHz operation, while still providing adequate room for the electronics associated with each antenna module.

SUMMARY OF THE INVENTION

The present invention is directed to a phased array antenna module for use in a phased array antenna system. The antenna module achieves antenna element spacing needed to achieve operation within the microwave frequency spectrum while providing a +/−60° elevation scan range. In one preferred form the module includes an electromagnetic wave energy distribution panel that is mounted to one side of a mandrel. The mandrel includes an input for receiving electromagnetic wave energy and a waveguide splitter for channeling the energy to the distribution panel. The distribution panel includes a 1×8 microstrip network and includes DC power and data logic circuitry. The distribution panel also includes the phase shifters, power amplifiers and applications specific integrated circuits (ASICs) needed for controlling the beam radiated from the module.

In one form the mandrel further includes a second end having a plurality of apertures into which a corresponding plurality of independent antenna components are housed. The antenna components each have at least one electromagnetic radiating element. The radiating elements are electrically coupled to the distribution panel via an interconnect assembly coupled at an edge of each distribution panel. In one preferred form the antenna components each comprise an antenna integrated ceramic chip carrier module such as that shown in FIG. 1*d*.

In one preferred embodiment a pair of electromagnetic wave distribution panels are disposed on opposite sides of the mandrel. The mandrel includes a 1×2 waveguide splitter formed between first and second longitudinal ends and in communication with an input at its first end. A pair of waveguide couplers are disposed on opposite sides of the mandrel to cover corresponding ports formed in the mandrel. The couplers couple electromagnetic wave energy split by the splitter and passing through the ports to each of the distribution panels. Thus, each of the distribution panels receive approximately 50% of the electromagnetic wave energy fed into the input. Each distribution panel feeds electromagnetic wave energy to one associated subplurality of the antenna modules.

The antenna system of the present invention provides the benefit of an in-line architecture through the use of at least one electromagnetic wave distribution panel mounted along a side portion of the mandrel. This provides ample room for the various electronic components needed for the antenna. The use of antenna components disposed at one end of the mandrel, and the use of the interconnect assembly, allows the tight radiating element spacing needed for V-band operation. A plurality of the antenna systems can be easily coupled together to form a single, larger antenna system having hundreds, or even thousands, of antenna modules.

In an alternative preferred embodiment an antenna module is provided that makes use of a flexible interconnect assembly for electrically coupling RF radiating elements with a plurality of electronic components of the module. The module includes a pair of chip carrier assemblies bonded directly to surfaces of a module core, thus making an excellent thermal coupling with the module core. The module core includes an input port and an internally formed waveguide splitter that splits electromagnetic wave energy fed into the input port between a pair of output ports formed on opposite sides of the module core. The module core is made from a metallic material and forms an efficient means for transmitting heat generated on the chip carrier assemblies to a heat sink on which the module is supported. The flexible electrical interconnect assembly electrically couples the chip carrier assemblies with a single aperture board that contains RF radiating elements.

Further areas of applicability of the present invention will become apparent from the following detailed description. The detailed description and specific examples are intended for purposes of illustration only and are not intended to limit the scope of the invention.

BRIEF DESCRIPTION OF THE DRAWINGS

The present invention will become more fully understood from the detailed description and the accompanying drawings, in which:

FIG. 4 is a bottom perspective view of the waveguide coupling element;

FIG. 5 is a cross sectional side view taken in accordance with section line 5—5 in FIG. 2 illustrating the 1×2 waveguide splitter formed in the mandrel, with a pair of waveguide coupling elements secured to opposite sides of the mandrel;

FIG. 6 is a side cross sectional view of the mandrel and antenna module interconnection, taken in accordance with section line 6—6 in FIG. 2;

FIG. 7 is a perspective view of an antenna system incorporating eight of the antenna modules shown in FIG. 2;

FIG. 11 is an exploded perspective view of the components of the antenna system of FIG. 10;

FIG. 22 is a plan view of a flexible circuit that is used to form a portion of the flexible connector assembly;

FIG. 26 is a perspective view of a portion of the flexible connector assembly coupled to the aperture board and the chip carrier assemblies;

DETAILED DESCRIPTION OF THE PREFERRED EMBODIMENTS

The following description of the preferred embodiment(s) is merely exemplary in nature and is in no way intended to limit the invention, its application, or uses.

Figure 1A:
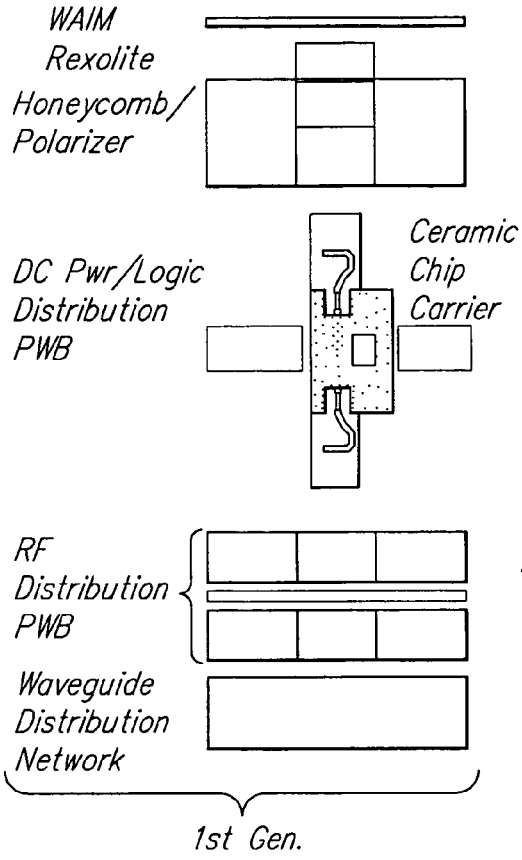
Prior Art FIG. 1a.
FIG. 1*a* illustrates a simplified schematic representation of the elements of an in-line antenna module.
Figure 1B:
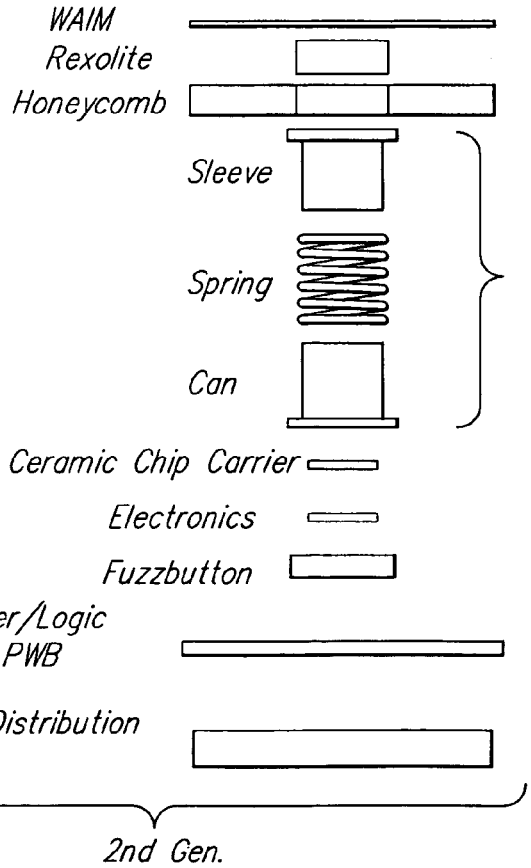
Prior Art FIG. 1b.
FIG. 1*b* illustrates a schematic representation of the elements of a can-and-spring antenna module.
Figure 1C:
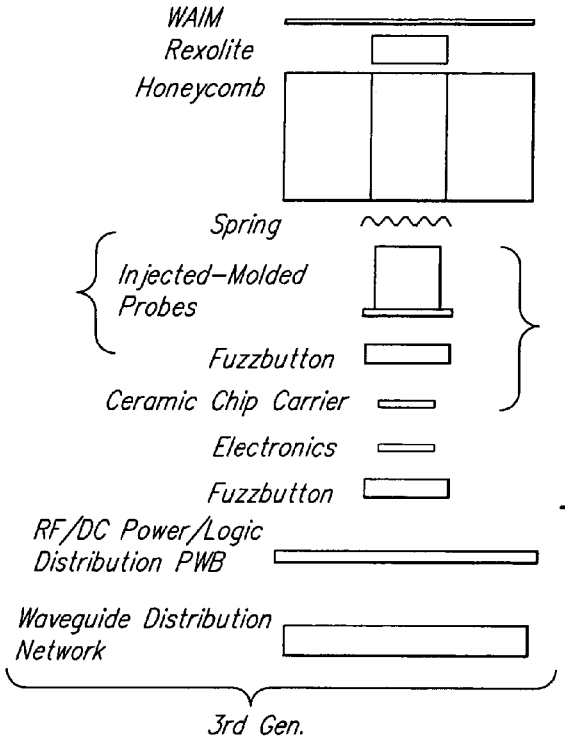
Prior Art FIG. 1c.
FIG. 1*c* illustrates a schematic representation of a molded antenna module.
Figure 1D:
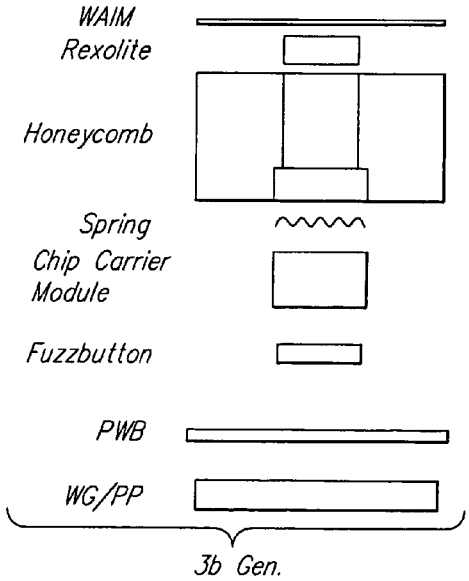
Prior Art FIG. 1d.
FIG. 1*d* illustrates a schematic representation of the elements used to construct an antenna integrated ceramic chip carrier module.
Figure 1E:
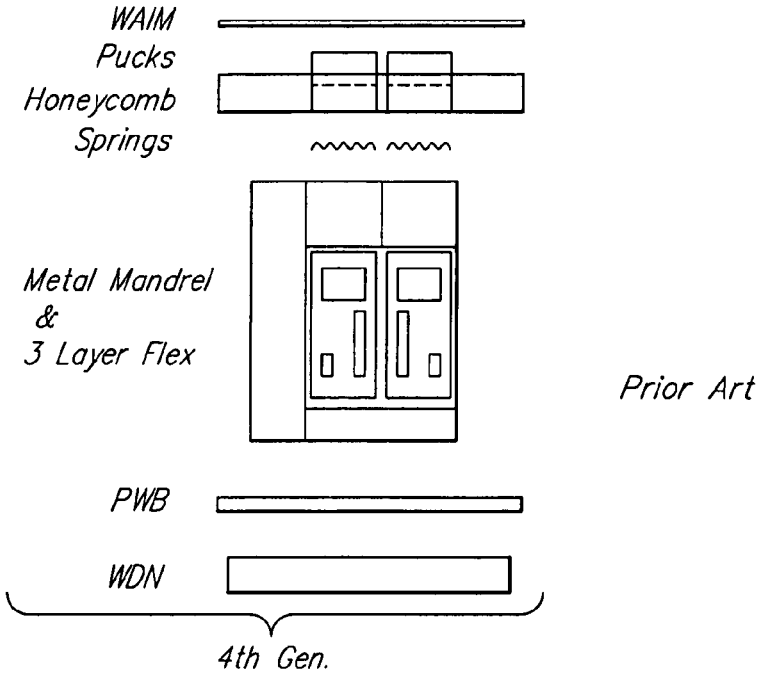
FIG. 1*e* is a simplified schematic view of the elements of a three dimensional flash cube quad-module antenna.
Figure 1F:
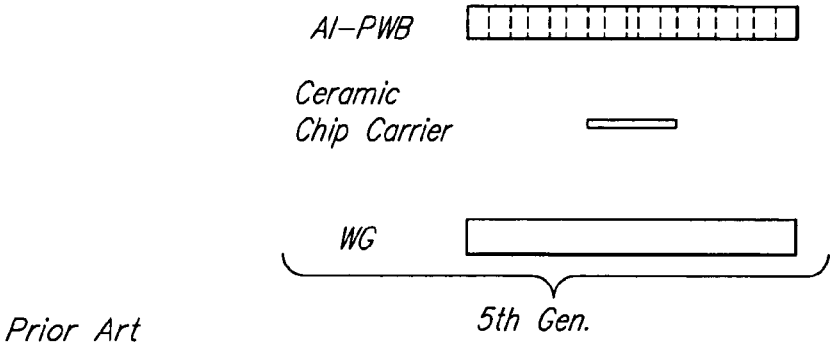
FIG. 1*f* is a perspective view of an antenna printed wiring board assembly in accordance with U.S. Pat. No. 6,670,930.
Figure 2:
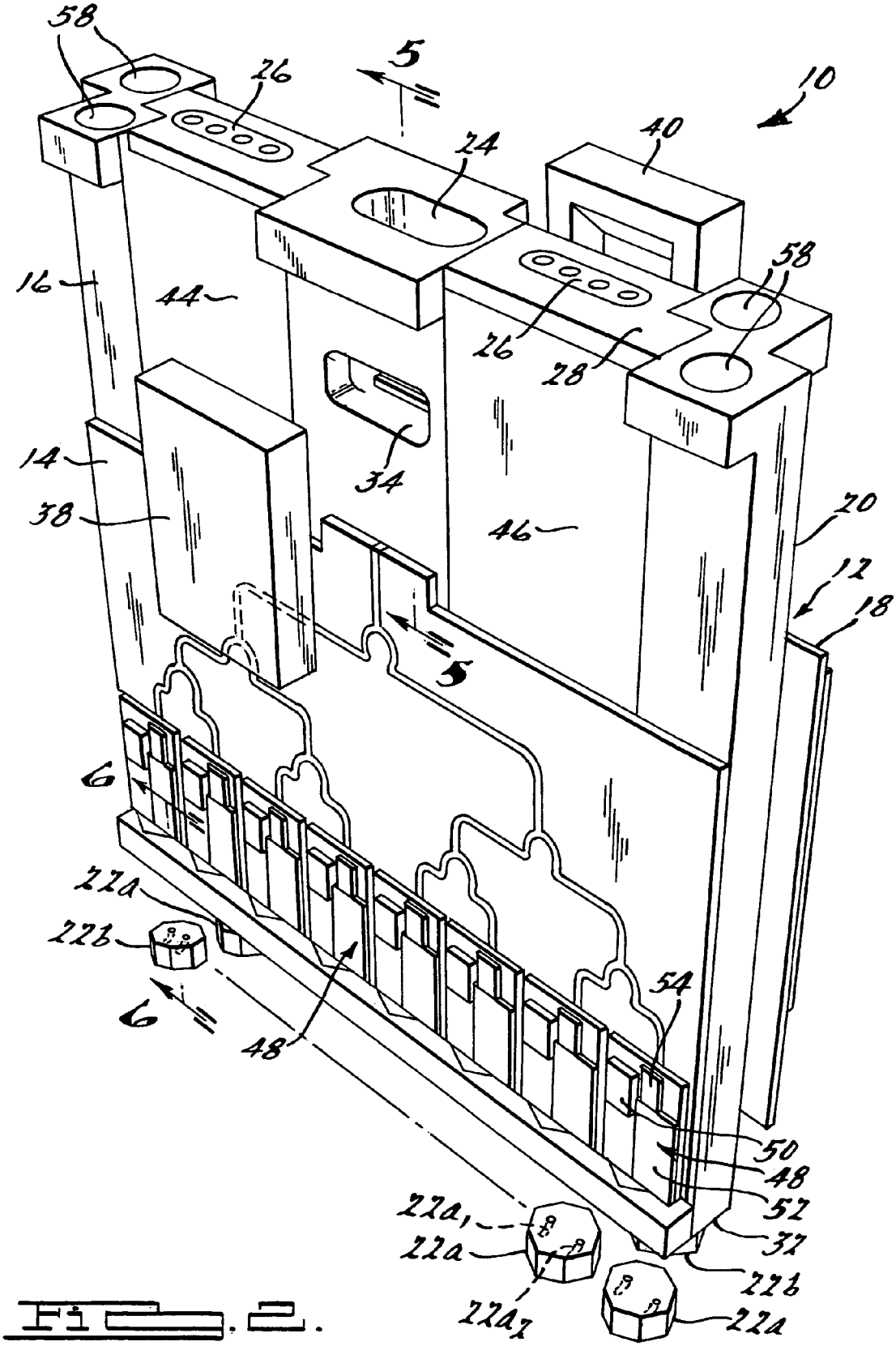
FIG. 2 is a perspective view of an antenna system in accordance with a preferred embodiment of the present invention.
Figure 3:
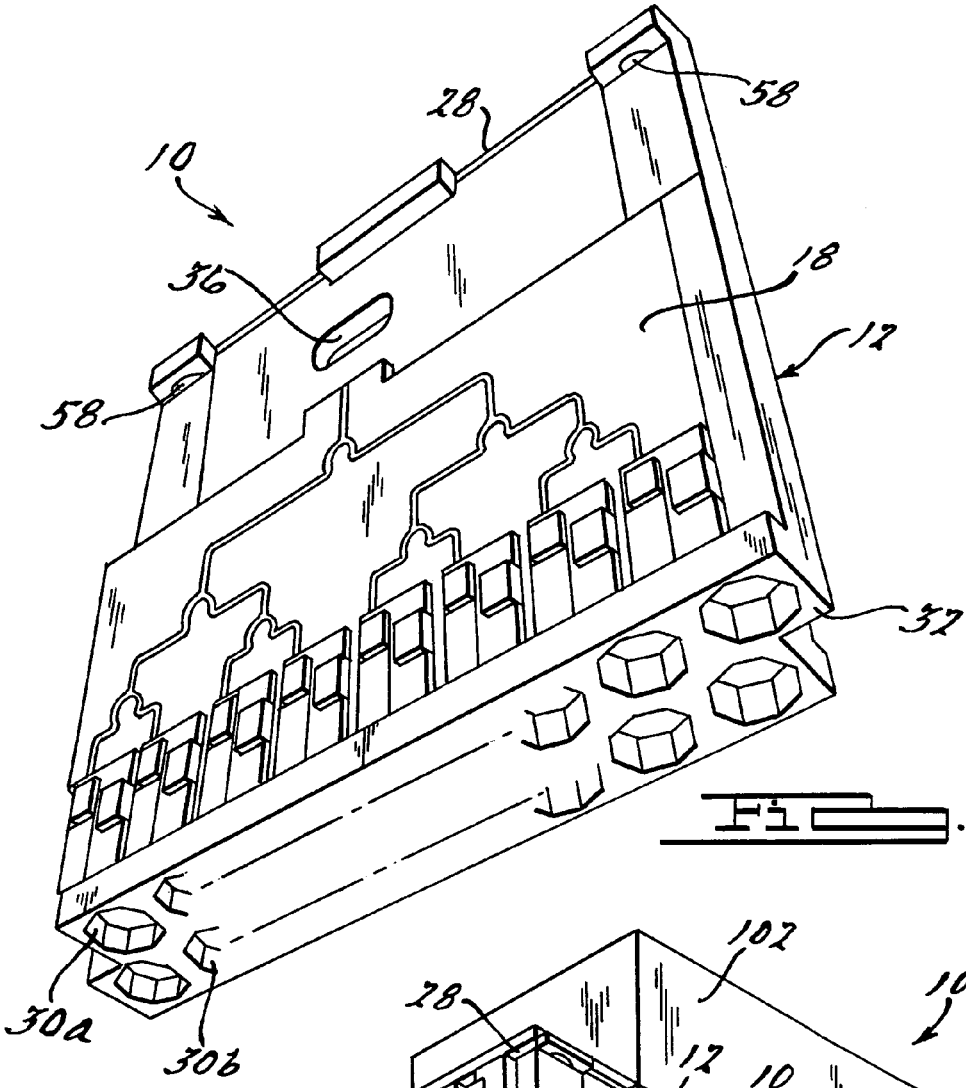
FIG. 3 is a bottom perspective view of the antenna system of FIG. 2 taken from the opposite side of the module, relative to FIG. 2.
Figure 2:
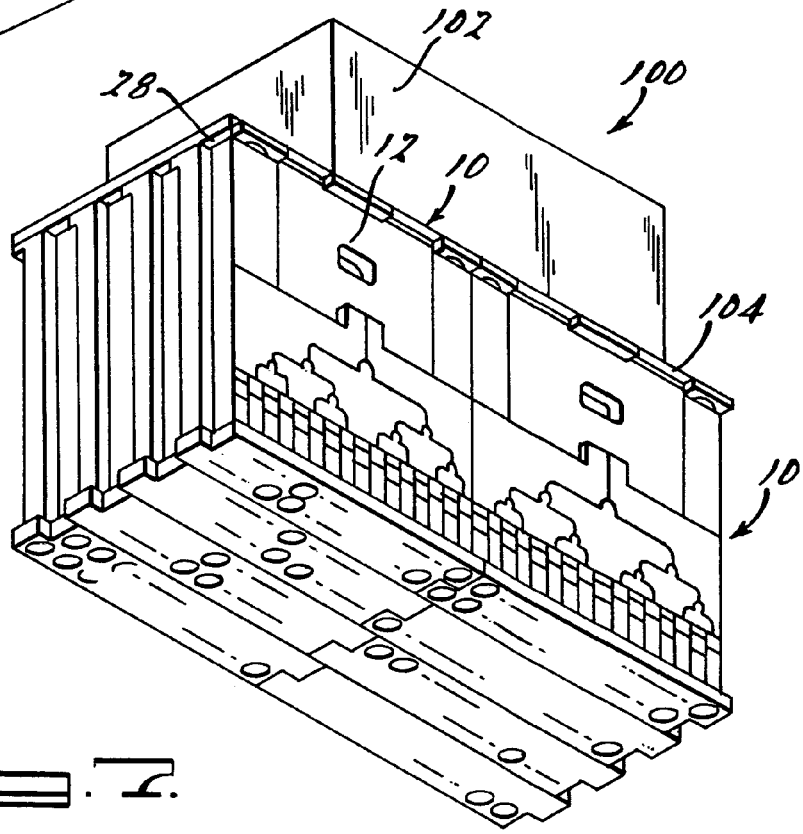

FIGS. 2 and 3 illustrate a phased array antenna module 10 in accordance with a preferred embodiment of the present invention. This preferred module 10 operates within the V-band spectrum, and more preferably at 60 GHz, with ±60° elevational scanning capability. The module 10 generally includes a core or mandrel 12, a first electromagnetic wave energy distribution panel 14 secured to a first side 16 of the mandrel 12, a second electromagnetic wave energy distribution panel 18 secured to a second opposing side 20 of the mandrel 12, and a pair of subpluralities of antenna modules 22*a* and 22*b*. The mandrel 12 includes an input 24 and a pair of spaced apart interconnects 26 for coupling to a printed circuit board (not shown). The interconnects 26 and the input 24 are formed at a first end 28 of the mandrel 12 and the modules 22*a* and 22*b* are disposed in openings 30*a* and 30*b*, respectively, at a second end 32 of the mandrel 12. The openings 30*a* and 30*b* are shown as hexagonal. Other shapes such as circular openings could readily be employed. The openings 30*a* and 30*b* receive the antenna components 22*a* and 22*b* in the desired orientation.

Components 22*a* and 22*b* may be AICC modules in accordance with the teachings of U.S. Pat. No. 6,580,402, the disclosure of which is incorporated by reference. It will be appreciated, however, that any other antenna component that provides the function of radiating electromagnetic wave energy could be implemented.

With further reference to FIGS. 2 and 5, the mandrel 12 includes an opening 34 formed on side 16 and an opening 36 formed on side 20 opposite the opening 34. With specific reference to FIG. 2, a first waveguide coupling element 38 is secured over the opening 34 and a second waveguide coupling element 40 is secured over opening 36. The two waveguide coupling elements 38 and 40 are identical in construction. The openings 34 and 36 are further in communication with the input port 24 and function to couple portions of the electromagnetic wave energy received through input port 24 with its associated distribution panel 14 or 18.

Referring to FIG. 4, the waveguide coupling element 38 is shown in greater detail. Waveguide coupling element 38 is preferably formed from a single block of electrically conductive material, for example aluminum, and essentially forms a cover for covering the opening 34. The element 38 includes a recessed area 38*a* having an angled surface 38*c* at one end of the recessed area and a centrally disposed rib that forms a projecting stepped waveguide transition surface 38*b* at the opposite end. One waveguide coupling element 38 is secured over each of openings 34 and 36, such by gluing with a conductive compound, like an epoxy.

Referring now to FIG. 5, the mandrel 12 includes a 1×2 waveguide splitter 42 formed internally adjacent the openings 34 and 36. The waveguide splitter 42 is longitudinally aligned with the input port 24 to receive the electromagnetic wave energy traveling through the input port 24 and to split the energy into approximately two equal portions. Approximately 50% of the electromagnetic wave energy is directed toward opening 34 and the other 50% toward opening 36. A step 38$b_1$ of stepped surface 38*b* contacts a circuit trace 14*a* on distribution panel 14 to transfer the electromagnetic wave energy channeled through opening 34 into the distribution panel. Angled surface 38*c* helps to channel electromagnetic wave energy received by the antenna system into the opening 34 during a receive phase of operation. During a transmit operation, openings 34 and 36 can be termed as "output" ports, while during a receive phase of operation they would form "input" ports, and input port 24 would instead function as an "output" port.

With further reference to FIGS. 2 and 3, printed circuit boards 44 and 46 couple the interconnects 26 with the distribution panel 14. A similar pair of interconnects (not shown) is disposed on the second side 20 of the mandrel 12 and serves to couple the interconnects 26 with the distribution panel 18.

Referring to FIGS. 2 and 6, each electronic module 48 in distribution panel 14 includes an application specific integrated circuit (ASIC) 50, a power amplifier 52 and a phase shifter 54. Each electronic module 48 is associated with a particular one of the antenna components 22*a* or 22*b*. With specific reference to FIG. 6, an enlarged view of a portion of the distribution panel 14 illustrates the coupling of one electronic module 48 with one antenna component 22*a*. A metallic wire or pin 56 extending from the antenna component 22*a* contacts the circuit trace 14*a* to make an electrical connection between the component 22*a* and the distribution panel 14. The wire or pin 56 is preferably epoxied to the circuit trace 14*a* or otherwise fixedly secured to make an excellent electrical connection with the electronics module 48. The wire or pin 56 also contacts one of radiating/reception elements (i.e., probes) 22$a_1$ of the antenna component 22*a* to electrically couple the distribution panel 14 to the radiating/reception element 22$a_1$ of the antenna component 22*a*. Each antenna component 22*a* includes a pair of radiating/reception elements in the form of elements 22$a_1$, such as illustrated in FIG. 2. Independent pins or wires 56 are independently coupled to each radiating/reception element 22$a_1$ and 22$a_2$. This form of electrical coupling avoids the bending limitations of a stripline conductor that heretofore has prevented the tight antenna module spacing required for +/−60° scanning in the gigahertz bandwidth, and thus allows electrical connections to be made to extremely tightly spaced antenna components.

The mandrel 12 is preferably formed from a single piece of metal, and more preferably from a single piece of aluminum or steel. The first end 28 further includes a plurality of openings 58 for allowing a plurality of antenna systems 10 to be ganged together to form a larger antenna system composed, for example, of hundreds of thousands of antenna components 22.

With reference now to FIG. 7, an antenna system 100 incorporating eight antenna modules 10 is illustrated. The antenna system 100 includes a 1×8 waveguide distribution network 102 which is coupled to a DC power/logic distribution printed wiring board 104. DC power/logic distribution printed wiring board 104 is in turn coupled to the first end 28 of each mandrel 12 of each antenna module 10. The antenna system 100 thus forms a 128 element millimeter wave (i.e., V-band) phased array antenna system. An even greater plurality of antenna system 10 components can be coupled together to form a 128 element, 256 element, or larger 1×N (where "N" is $2^i$ and "i" is an integer) phased array antenna system. Accordingly, it will be appreciated that antenna systems having varying numbers of radiating elements can be assembled using various numbers of the module 10 of the present invention.

Figure 8:
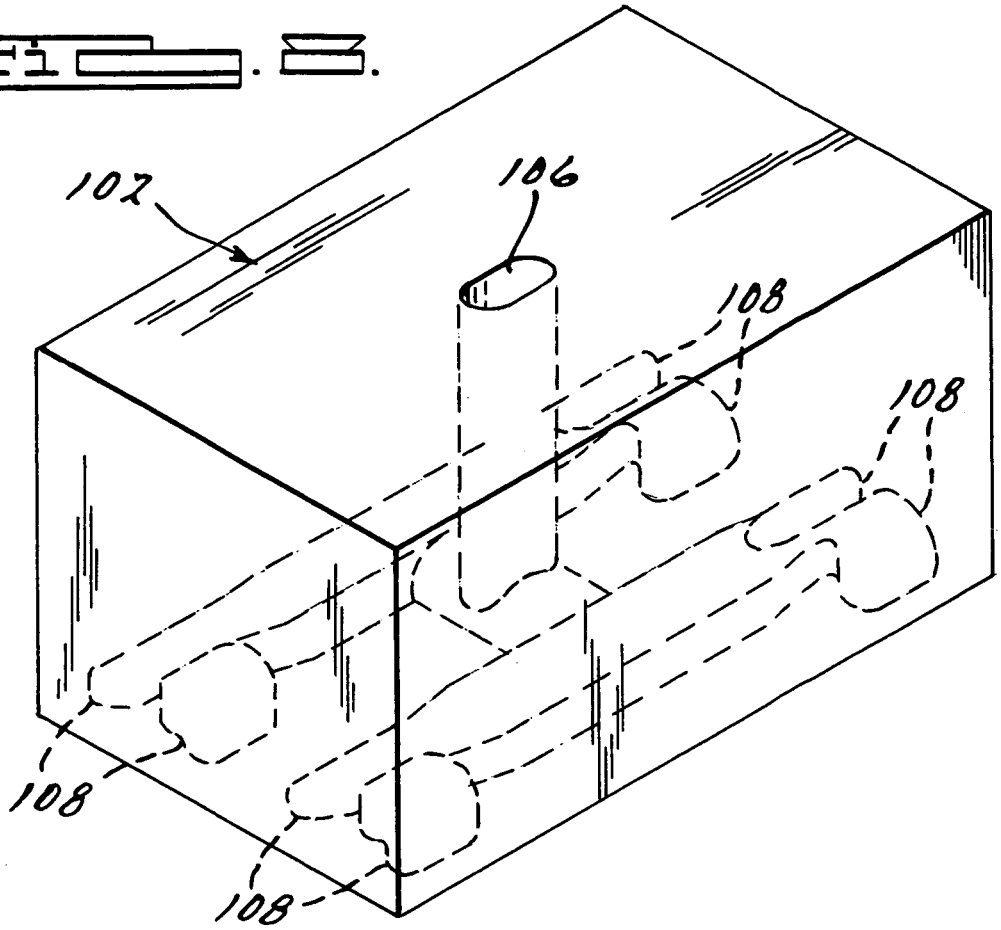
FIG. 8 is a perspective view of the waveguide distribution network component used with the antenna system of FIG. 7.
Figure 9:
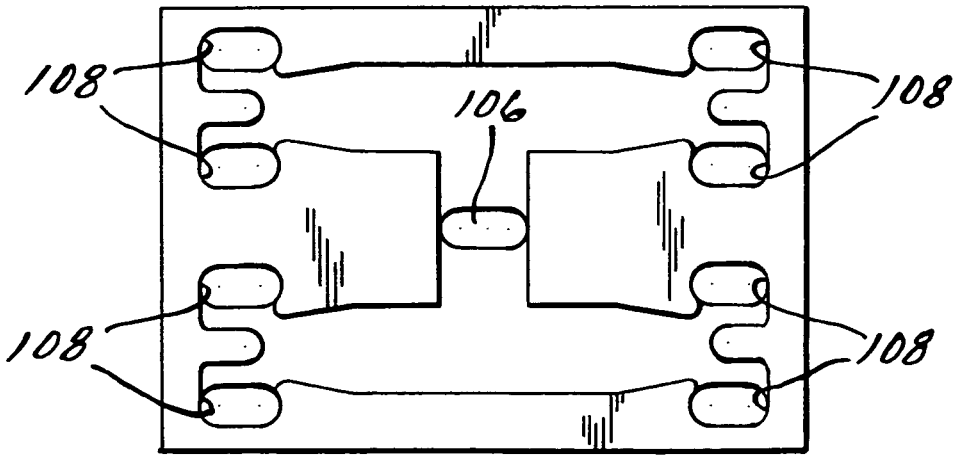
FIG. 9 is a bottom plan view of the waveguide distribution network component of FIG. 8.

Referring to FIGS. 8 and 9, the 1×8 waveguide distribution network 102 can be seen. Network 102, in this example, functions to divide electromagnetic wave energy received through an input port 106 evenly between eight output ports 108. Each output port 108 is longitudinally aligned with an associated input port 24 of the adjoining antenna modules 10 to allow a portion of the electromagnetic wave energy passing through the output port 108 to enter the input port 24 of each antenna module 10. The printed wiring board 104 includes eight sections or areas which form conventional "pass throughs" (i.e., essentially waveguide structures) to enable the electromagnetic wave energy to pass from each of the outputs 108 through an associated pass through and into an associated input port 24 of one of the antenna modules 10. Interconnects 26 (FIG. 2) further electrically couple with portions of the DC power/logic board 104 on opposite sides of an associated one of the pass throughs so the DC power and logic signals can be provided to the distribution panels 14 and 18 of module 10, and, accordingly throughout the entire phased array system.

Figure 10:
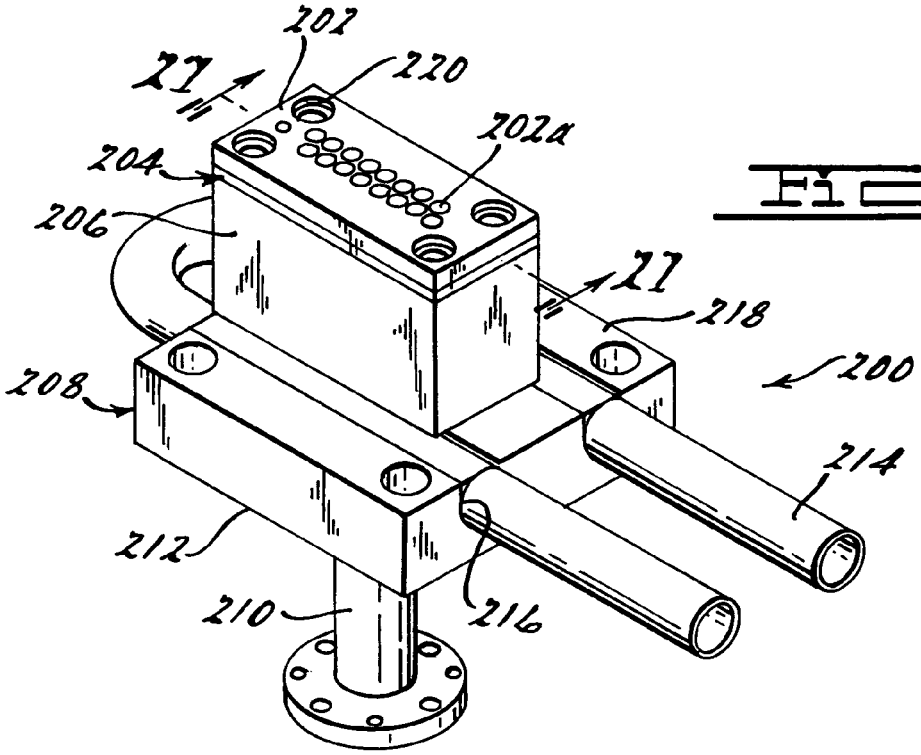
FIG. 10 is a perspective view of a 16 element antenna in accordance with an alternative preferred embodiment of the present invention.
Figure 11:
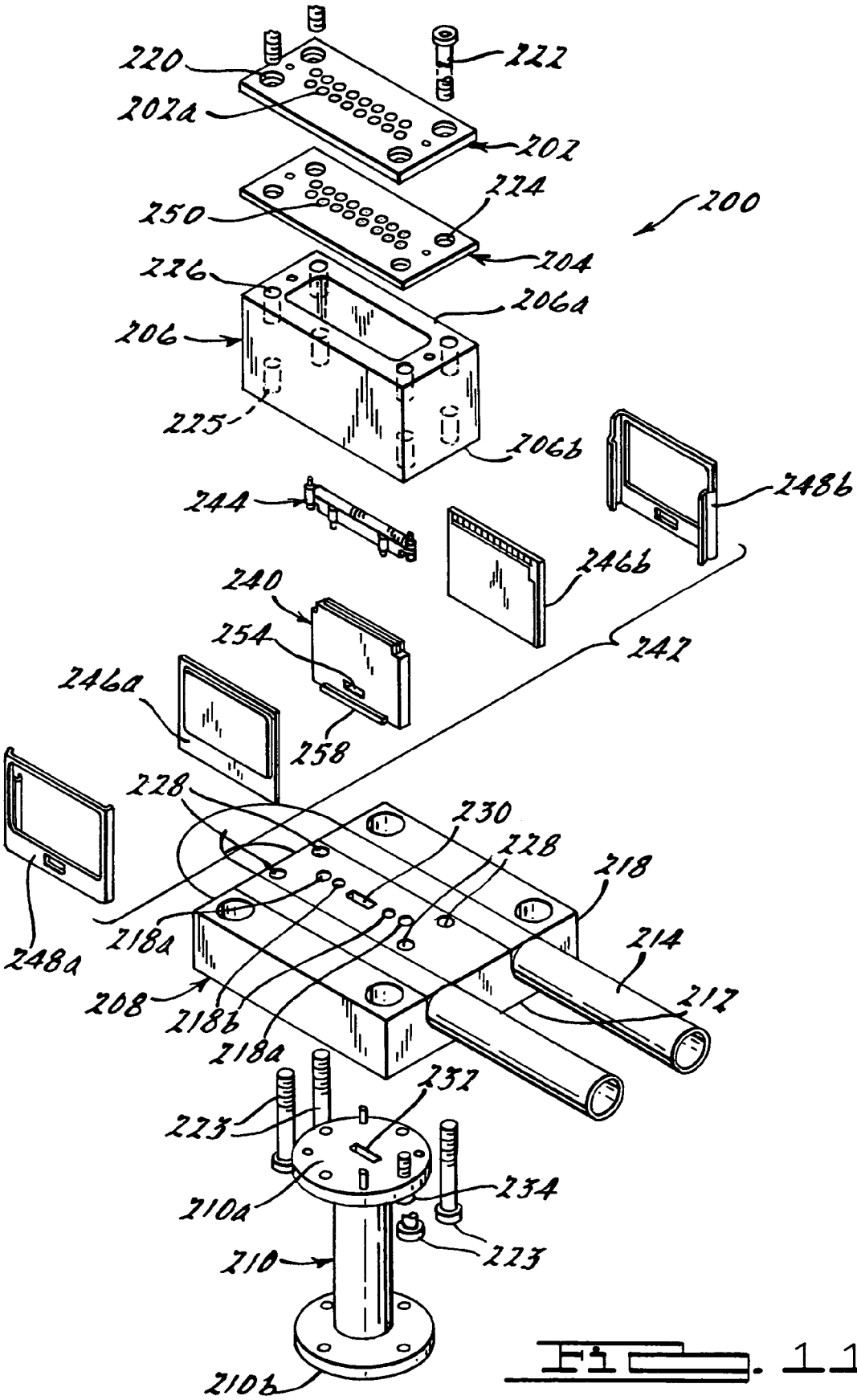
FIG. 11 is an exploded perspective view of the components of the antenna module of FIG. 10.

Referring to FIGS. 10 and 11, an antenna system 200 incorporating an alternative preferred embodiment of the antenna module is shown. The antenna system 200 is illustrated as a sixteen RF element system, but the system 200 could be formed with a greater or lesser plurality of radiating elements.

The antenna system 200 includes a conventional honeycomb plate 202, typically referred to in the industry as simply a "honeycomb", secured over an aperture board 204. The honeycomb plate 202 is preferably made from metal, and more preferably from aluminum. The honeycomb plate 202 and the aperture board 204 are secured to a hollow, metallic support frame 206. The support frame 206 is secured to a heat sink assembly 208. Heat sink assembly 208 is secured to a waveguide adapter 210 on an undersurface 212 of the heat sink assembly 208. The heat sink assembly 208 includes a fluid carrying conduit 214 located within a channel 216 of a metallic cold plate 218 for providing liquid flow through cooling to the heat sink assembly 208.

With specific reference to FIG. 11, the honeycomb 202 includes a plurality of apertures 220 for receiving threaded fastening members 222. Openings 202*a* form waveguides for electromagnetic wave energy passing to/from the aperture board 204. Each opening 202*a* may be filled with a conventional dielectric plug, such as a plug made from REXOLITE® cross-linked, polystyrene, microwave plastic, or from ULTEM® polyetherimide thermoplastic.

Aperture board 204 likewise includes a plurality of apertures 224, and the support frame 206 includes a plurality of blind threaded bores 226 opening from surface 206*a*. The cold plate 218 includes a plurality of holes 228. Fasteners 222 extend through apertures 220 and apertures 224 into threaded holes 226. Fasteners 223 extend through apertures 228 of the cold plate 218 into four threaded blind holes 225 of the frame 206 that are co-linear with threaded holes 226 but on edge 206*b* of support frame 206. The cold plate 218 also includes a waveguide opening 230. Opening 230 is aligned with a bore 232 within the waveguide adapter 210 when the waveguide adapter 210 is secured via fasteners 234 to the undersurface 212 of the cold plate 218. Aperture 232 has the same rectangular geometry as aperture 230 on a top end 210*a* of the adapter 210. Also, aperture 230 has a constant cross section through the cold plate 218 while aperture 232 forms a tapered rectangular waveguide that changes height as it passes through adapter 210. In this example, aperture 232 is designed to mate with a WR 19 standard waveguide on the bottom end 210*b* of the adapter 210, while mating with aperture 230 on the top end 210*a*. Aperture 230 may be called a custom, "reduced height" waveguide based on the standard WR 19 size. The purpose of adapter 210 is to transform the signal from a WR 19 waveguide to a reduced height, WR 19 waveguide.

Referring further to FIG. 11, within the support frame 206, a metallic module core or mandrel 240 holds a module 242 and a flexible connector assembly 244. The module 242 includes a pair of signal distribution panels in the form of chip carrier boards 246*a*, 246*b*, and a pair of retainer clips 248*a*, 248*b*. Chip carrier board 246*a* and retainer clip 248*a* form a first pair of components that are secured to one side of the core 240, while chip carrier board 246*b* and retainer clip 248*b* form a second pair of components that are secured to the opposite side of the core 240. The flexible connector assembly 244 is used to electrically couple the chip carrier boards 246 with the aperture board 204.

Figure 12:
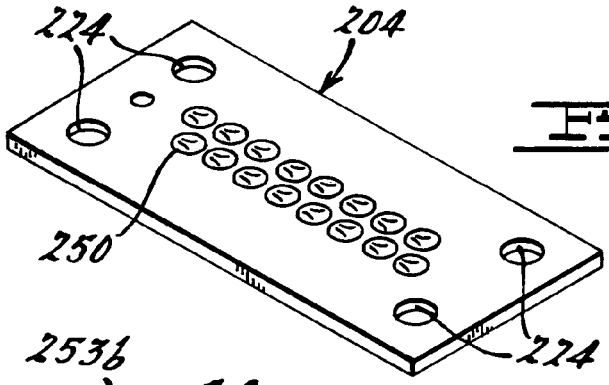
FIG. 12 is an enlarged plan view of the aperture board of the antenna system.

Referring to FIG. 12, the aperture board 204 is shown in greater detail. The aperture board 204 is preferably formed in accordance with the teachings of U.S. Pat. No. 6,670,930. The aperture board 204 essentially forms a multi-layer printed wiring board that combines a plurality of dual-polarized, electromagnetic wave radiating/reception elements 250 (in this example 16 such elements) with DC power distribution and logic distribution functions. For convenience, elements 250 will simply be referred to throughout as "radiating" elements 250. Radiating elements 250 are aligned with the openings 202*a* so that each opening 202*a* forms a waveguide for a respective one of the sixteen radiating elements 250. The aperture board 204 enables DC power and logic signals to be applied to drive ASICs and monolithic microwave integrated circuits (MMICs) on each of the chip carrier boards 246*a*, 246*b*. Each radiating element 250 includes a pair of RF elements (i.e., probes) to provide dual polarization transmit and receive capability to the antenna 200. The aperture board 204 and the chip carrier boards 246*a*, 246*b* can be constructed to provide the antenna 200 with transmit and receive capabilities over a desired bandwidth, and in one specific implementation over a frequency bandwidth spanning at least between about 40 GHz–60 GHz.

Figure 13:
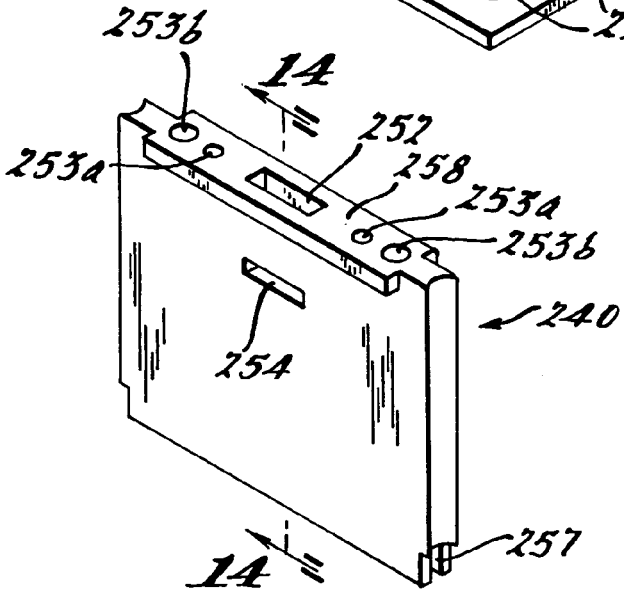
FIG. 13 is an enlarged perspective view of the module core.
Figures 14, 15, 15A, 16, 16A:
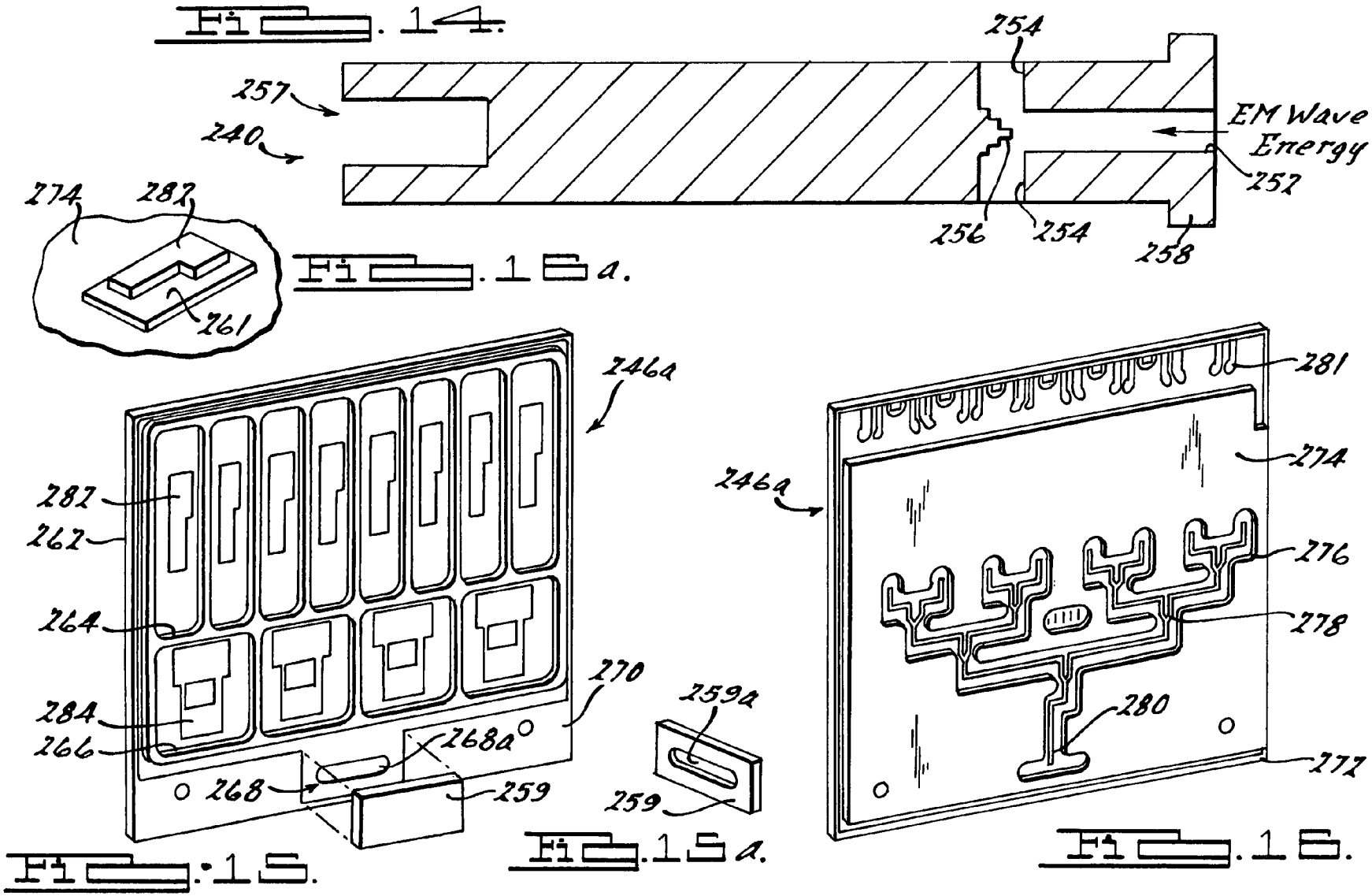
FIG. 14 is a cross sectional side view of the module core in accordance with section line 14—14 in FIG. 13.
FIG. 15 is a perspective view of a front side of one of the chip carrier assemblies.
FIG. 15*a* is a perspective view of a rear surface of a cover that covers the waveguide backshort shown in FIG. 15.
FIG. 16 is a perspective view of the rear side of the chip carrier assembly of FIG. 15.
FIG. 16*a* is a perspective view of one of the molytabs used to support each MMIC chip set on a heat spreader panel.

Referring to FIGS. 13 and 14, the module core 240 includes a waveguide input port 252 and a pair of output ports 254 formed on opposite surfaces. The module core 240 may comprise aluminum or any other highly thermally conductive material, such as brass or molybdenum. The module core 240 may be formed from a single piece of material, or from several pieces of material bonded or otherwise secured together. With reference to FIG. 14, the module core 240 includes, in this embodiment, a 3 dB splitter 256 that divides the electromagnetic wave energy fed through input 252 evenly between the two output ports 254. A channel 257 is formed at one end of the module core 240 for receiving a portion of the flexible connector assembly 244 when the module 242 is assembled.

Figure 18:
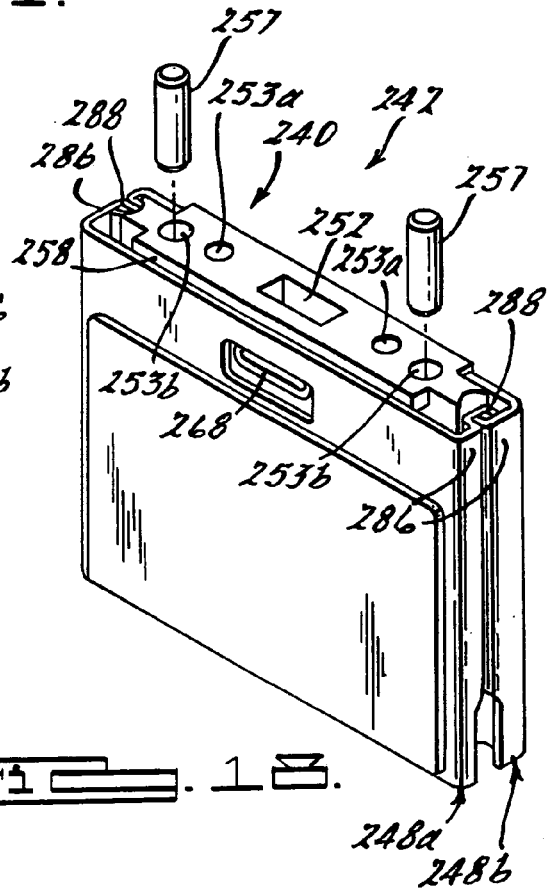
FIG. 18 is a bottom perspective view of the assembly shown in FIG. 17.

As shown in FIG. 18, this module core 240 also includes a flange 258 to help secure the core to the cold plate 218 and to increase the contact surface area between module core 240 and the cold plate 208 to facilitate heat-transfer. Four blind holes 253*a* and 253*b* are tapped in the module core 240 adjacent the port 252. Holes 253*a* are threaded and receive screws (not shown) that pass through holes 218*a* in the cold plate 218 (FIG. 11) to fasten these components together. The remaining pair of holes 253*b* accept close fitting alignment pins 257 that also extend into holes 218*b* in the cold plate 218 in order to align waveguide port 252 in the module core 240 with waveguide opening 230 in the cold plate 218.

Referring to FIGS. 15 and 16, one chip carrier board 246*a* is shown in greater detail. Each chip carrier board 246 comprises a low temperature, co-fired ceramic (LTCC) substrate 262 having in this case eight holes 264 and four recesses 266. A waveguide backshort 268 is formed on a front side 270 of the LTCC substrate 262. The waveguide backshort 268 functions to provide a transition from a waveguide (i.e., waveguide adaptor 210) to a TEM transmission line such as a microstrip.

Reference numeral 268*a* indicates an elongated, rectangular embedded waveguide coming to the surface of the ceramic chip carrier board 246*a*, and forms part of the waveguide backshort 268 structure. Often waveguides are hollow cavities in metal structures, as in port 252, but in this instance embedded waveguide 268*a* is a continuous part of the ceramic substrate of chip carrier board 246*a*. Metal traces and vias are arranged in the ceramic substrate so that the region electrically acts as a waveguide even though there is no actual slot cut in the ceramic that forms board 246*a*. The actual shorting part of the waveguide backshort 268 consists of a rectangular plate of metal 259 (preferably KOVAR™ super alloy or ALLOY 42 iron-nickel alloy 42) approximately 0.010 inch (0.254 mm) thick, of sufficient size to cover this waveguide backshort 268 opening. Referring to FIG. 15*a*, plate 259 is attached to the ceramic chip carrier board 246*a* with conductive epoxy to cover waveguide backshort 268. The waveguide backshort plate 259 may itself contain a very short length of waveguide 259*a* on the order of 0.002 inches (0.0508 mm) long, corresponding to the size of the embedded waveguide 268*a* and contiguous with waveguide backshort 268. Waveguide 259*a* forms a 0.002-inch-deep rectangular recess in one side of the waveguide backshort plate 259. The purpose of this part is to terminate the waveguide 268*a* with a short (that is, cover it with a conductor). Doing so is necessary to facilitate transmission of RF energy from waveguide port 254 in the module core 240 to trace 280 (FIG. 16) in the ceramic package 246*a*. Adjusting the length of the waveguide 259*a* located in the waveguide backshort plate 259 tunes the transition so that efficiency of this transition is maximized. In some embodiments, the waveguide 259*a* in the backshort plate 259 may be filled with a thin piece of dielectric material such as ceramic or plastic to further tune the transition.

In FIG. 16, a rear surface 272 of the LTCC substrate 262 includes a metallic heat spreader panel 274 that is brazed or otherwise secured to the rear surface 272. Panel 274 has a cutout 276 to avoid shorting an electrically conductive distribution network 278 formed on the rear surface 272 of the LTCC substrate 262. The network 278 feeds microwave energy from a strip line transition portion 280 to various components on the chip carrier board 246*a*. The microwave energy is that one-half portion of the input energy that flows through the port 254 (FIG. 14) of the core 240 that the strip line transition portion 280 is positioned over when the module 10 is assembled. Input/output (I/O) portions 281 electrically couple the chip carrier board 246*a* with the aperture board 240. The chip carrier boards 246 are bonded directly to the core 240 to form an excellent and direct (conductive) thermal coupling that facilitates cooling of the module 10. This allows for highly efficient cooling of the electronic components on the chip carrier assemblies 246.

With further reference to FIGS. 15 and 16, within each hole 264 is mounted a MMIC chip set 282. Each MMIC chip set 282 consists of a power amplifier, a driver amplifier and a phase shifter MMIC. Each MMIC chip set 282 is supported on the heat spreader panel 274 and is electrically coupled to an associated radiating element 250 (FIG. 12) via I/O lines 281. An ASIC chip set 284 disposed within each recess 266 controls the phase shifter MMICs of an associated pair of MMIC chip sets 282. In FIG. 15, each ASIC chip set 284 controls the phase shifter MMICs of the two MMIC chip sets 282 located immediately above it. The distribution network 278 in FIG. 16 divides electromagnetic wave energy input to the strip line transition portion 280 evenly to each of the MMIC chip sets 282 so that each radiating element 250 receives 1/16 of the total energy input at port 252.

The metallic heat spreader panel 274 is a thermally conductive metal plate preferably about 0.015 (0.381 mm) inch thick, composed of any material with a coefficient of thermal expansion similar to the ceramic substrate 262, for example molybdenum, copper-tungsten, or copper-moly-copper laminate. The panel 274 has several purposes. Since holes 264 penetrate through the entire ceramic substrate, each hole 264 must have a floor on which MMIC chip set 282 may be directly or indirectly mounted. The heat spreader panel 274 covers the holes 264 and provides a surface on which the MMIC chip sets 282 may be subsequently mounted from the opposite side of the chip carrier board 246*a*. Also, integrated circuit components may be indirectly mounted to the heat spreader panel 274 via a molytab 261, as shown in FIG. 16*a*. A small block of molybdenum (i.e., molytab 261) is affixed to the heat spreader panel 274 by means of conductive epoxy. The MMIC chip sets 282 are then mounted to the molytab 261 with conductive epoxy. The purpose of the molytab 261 is to make the top surface of each of the MMIC chip sets 282 coplanar with the top surface of the ceramic chip carrier board 246*a* and to provide a direct thermal path from the chip sets 282 to the heat spreader panel 274. The heat spreader panel 274 further provides a direct heat path from the molytab 261 to the module core 240, with the module core 240 being in metal-to-metal contact with the cold plate 218. Therefore a continuous heat transfer path is formed from the back of each chip set 282 to the cold plate 218. The metals used have a high thermal conductivity, limiting MMIC chip set 282 operating temperature and providing for extended MMIC chip set life. If the MMIC chip sets 282 were mounted directly to the ceramic substrate without the use of a molytab and heat spreader panel 274, the MMIC chip set operating temperature would likely be somewhat higher than it is with the present embodiment. Mounting the MMIC chip sets 282 to an all-metallic structure also reduces the probability that the chip sets will experience a feedback condition, commonly called oscillation, that causes MMIC amplifiers to output large amounts energy at undesired frequencies.

Figure 17:
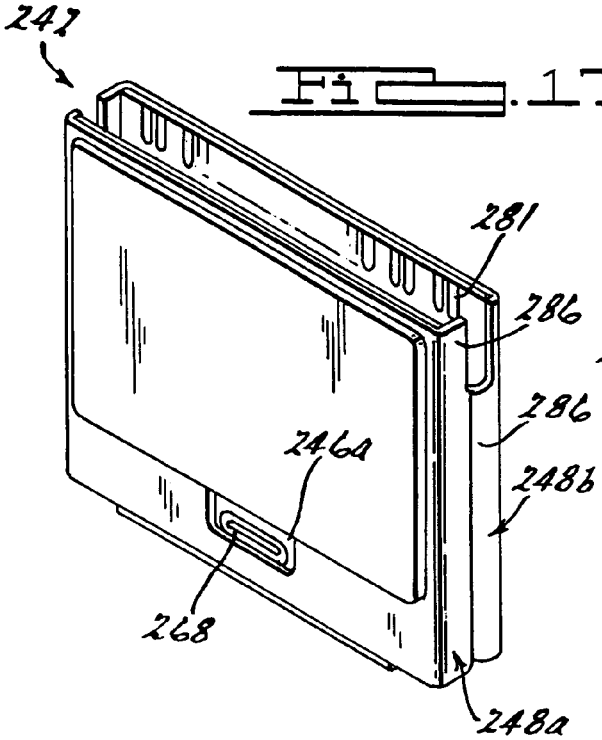
FIG. 17 is a perspective view of the antenna module used to form the antenna system of FIG. 10.

Referring to FIGS. 17 and 18, the chip carrier assembly 242 is shown assembled to the core 240. Each retainer clip 248 is preferably made from stainless steel tempered to a spring condition and includes a pair of curved arms 286 that interlock with one another. The arms 286 are secured from separating by pins 288 (FIG. 18) that are inserted into each pair of interlocked arms 286.

Figure 19:
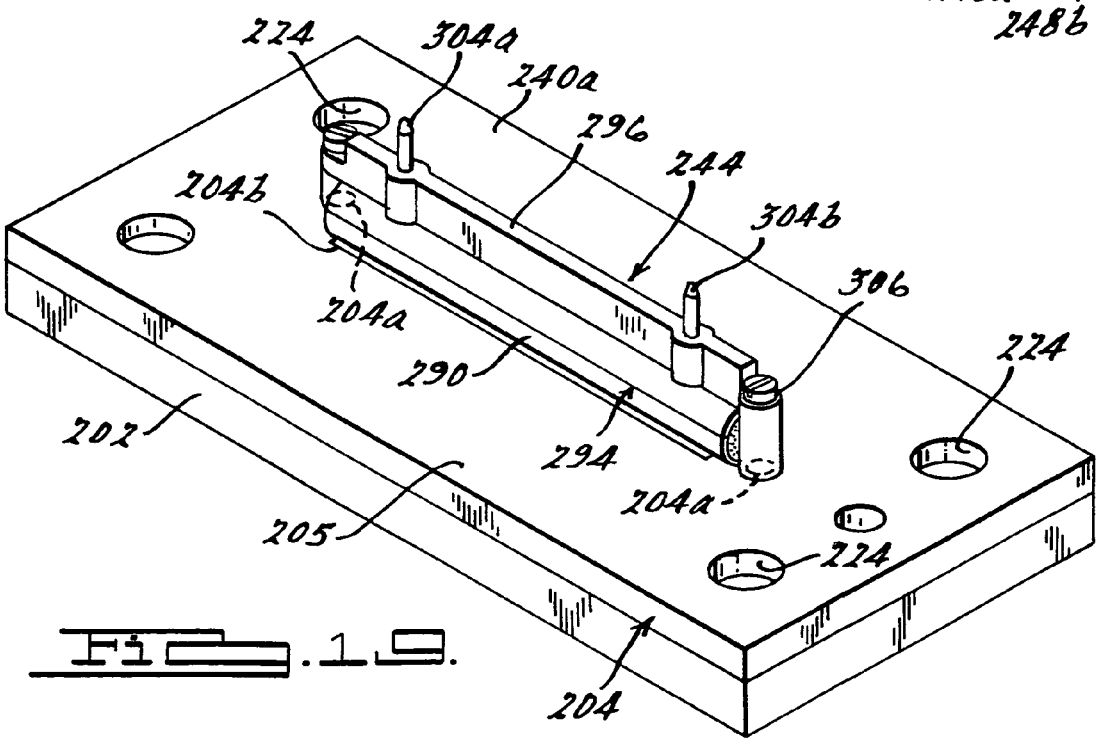
FIG. 19 is a perspective view of the flexible connector assembly secured to the aperture board.

In FIG. 19 the flexible connector assembly 244 is shown coupled to an undersurface 205 of the aperture board 204. The assembly 244 is used to electrically interconnect the I/O lines 281 of each chip carrier board 246 with circuit traces, indicated in highly simplified form by reference numeral 204*b*, on the aperture board 204. This enables electrical communication between the radiating elements 250 and the chip carrier boards 246.

Figure 20:
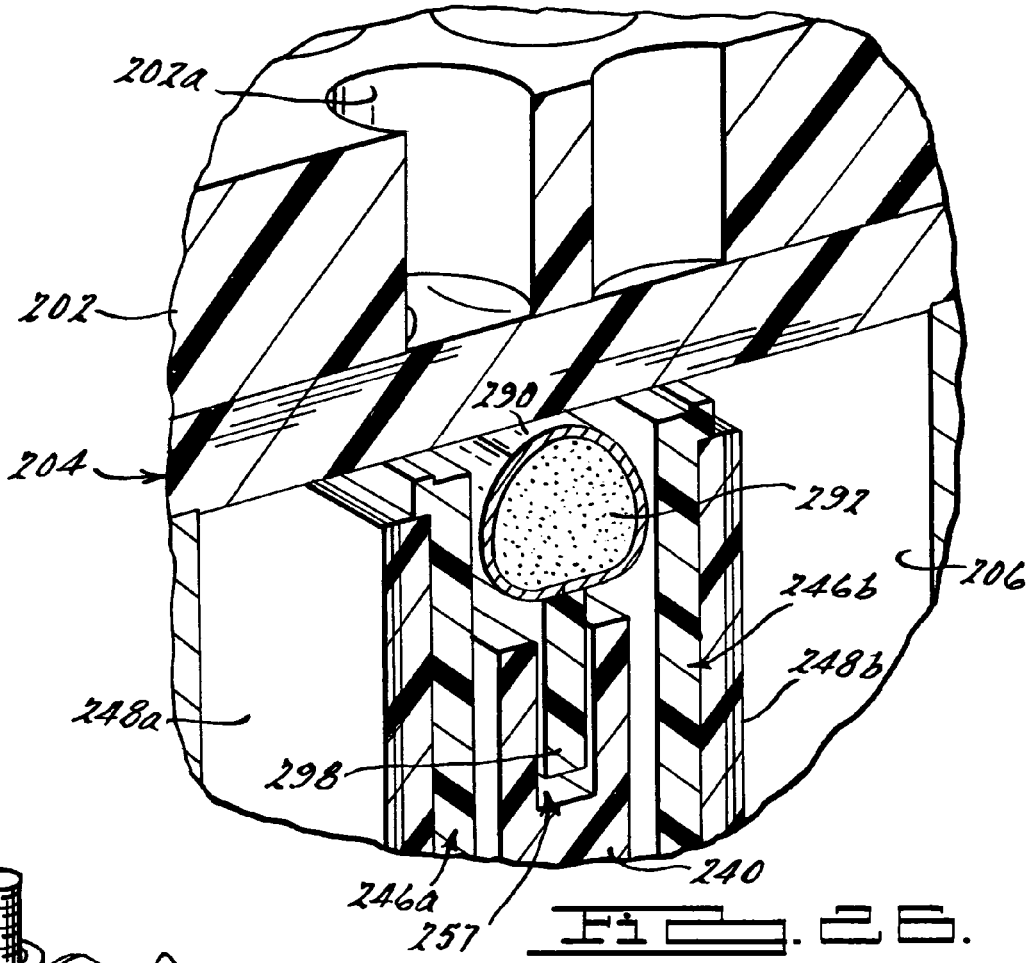
FIG. 20 is an exploded perspective view of the flexible connector assembly.
Figure 21:
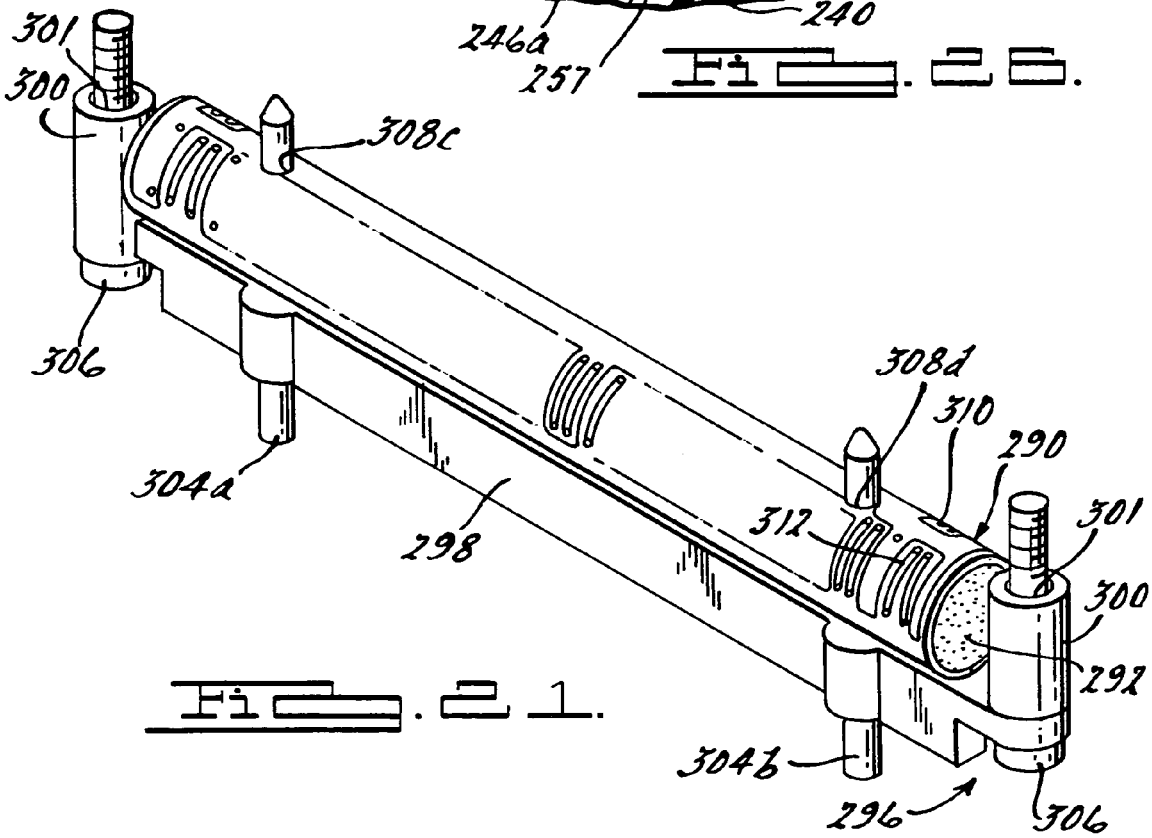
FIG. 21 is an assembled, perspective view of the flexible connector assembly.

Referring to FIGS. 20 and 21, the flexible connector assembly 244 includes a flexible circuit assembly 290 which is wrapped over an elongated, cylindrical compressible member 292 to form a compressible electrical coupling subassembly 294. The compressible subassembly 294 is supported on a holder subassembly 296. The holder subassembly 296 includes a frame 298 having sleeves 300 formed at opposite ends. The frame 298 further has bores 302 to receive alignment pins 304*a*, 304*b*. Each sleeve 300 has a bore 301 that receives a threaded fastener 306 to secure the holder assembly 296 to the aperture board 204. The frame 298 may be made from any suitably rigid material such as metal or plastic. Referring briefly to FIG. 19, the aperture board 204 includes threaded blind holes 204*a* that receive the threaded fasteners 306.

With specific reference to FIG. 22, the flexible electrical circuit 290 is illustrated before the circuit has been secured to the compressible member 292. The flexible electrical circuit 290 includes a plurality of holes 308*a* and 308*b* adjacent the four corners of the circuit 290. Holes 308*a* overlay one another, and holes 308*b* similarly overlay one another, when the circuit 290 is wrapped over the compressible member 292. Hole 308*c* is longitudinally aligned with the holes 308*a* when the flexible circuit 290 is rolled over the compressible member 292. Similarly, hole 308*d* is longitudinally aligned with holes 308*b* when the flexible circuit 290 is rolled and secured over the compressible member 292.

Figure 23:
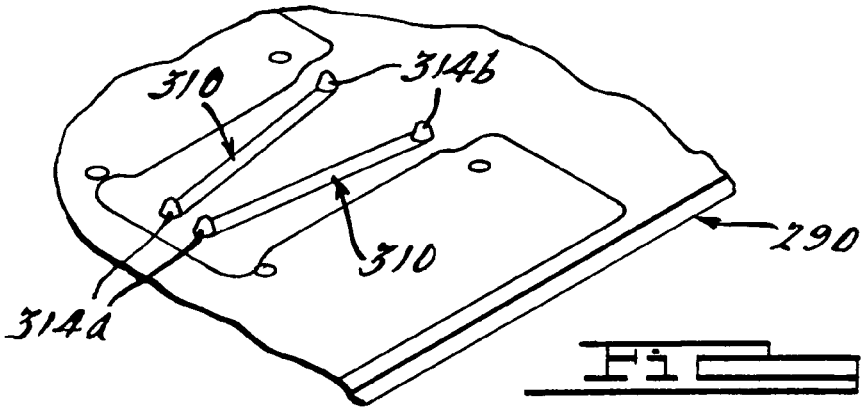
FIG. 23 is an enlarged perspective view of a pair of traces of the flexible circuit of FIG. 22.

The flexible circuit 290 includes a first plurality of circuit traces 310 formed in a longitudinal line, and a second plurality of circuit traces 312 also formed in a longitudinal line adjacent the first plurality of circuit traces 310. The traces 310 and 312 are preferably formed on a sheet of polyimide having a thickness in the range of preferably about 0.0005 inch to 0.002 inch (0.0127 mm–0.0508 mm), excluding the thickness of the circuit traces 310 and 312 (typically copper having a thickness of between 0.0035 inch–0.0007 inch; 0.089 mm–0.018 mm). The above-described thickness range, as well as the width of each of the traces 310 and 312, will need to be considered together to achieve the desired impedance (in the present embodiment about 50 ohms). While only two rows of circuit traces 310 and 312 are shown, a greater or lesser plurality of rows of circuit traces could be used to feed power at the desired impedance. Circuit traces 310 each include a pair of raised electrical contacts or pads 314*a* and 314*b*, while traces 312 similarly include raised electrical contacts or pads 316*a* and 316*b*. With brief reference to FIG. 23, the raised electrical contacts 314*a* and 314*b* of one of the circuit traces 310 are illustrated in enlarged fashion.

Figure 24:
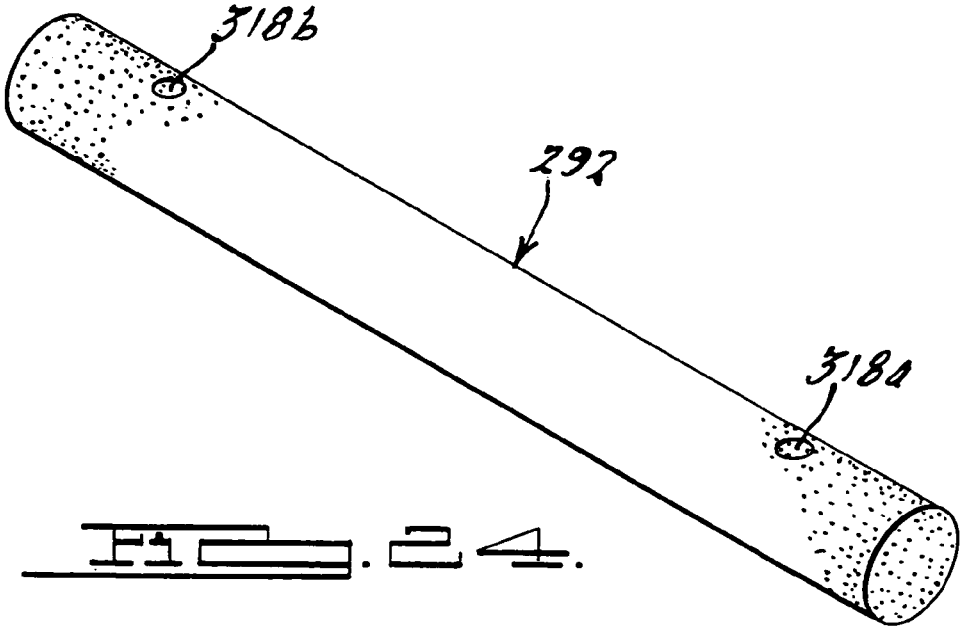
FIG. 24 is a perspective view of an elastomeric member used with the flexible connector assembly.

With reference to FIG. 24, the compressible member 292 is shown in greater detail. The compressible member 292 may be formed from any resilient, deformable material, but in one preferred form comprises a silicone rubber cord of generally circular cross section with a Shore A durometer rating of approximately 60. Such material is manufactured by Parker Seal Co. of Lexington, Ky. The compressible member 292 includes a pair of bores 318*a* and 318*b* that are formed with a spacing in accordance with the spacing separating holes 308*c* and 308*d* of the flexible electrical circuit 290. The diameter of the compressible member 292 may vary to suit the needs of a specific application, but in one preferred form comprises a diameter of between about 1.025–1.055 inch (2.6–2.67 mm). Similarly, the overall length may vary to accommodate electrically coupling to various pluralities of circuit traces on the aperture board 204. Furthermore, the compressible member 292 may take other shapes besides a cylindrical shape. Spherical compressible members, oval shaped members or other shapes could be employed to suit the needs of specific applications, provided the flexible circuit assembly 290 can still be wrapped over the compressible member.

Figure 25:
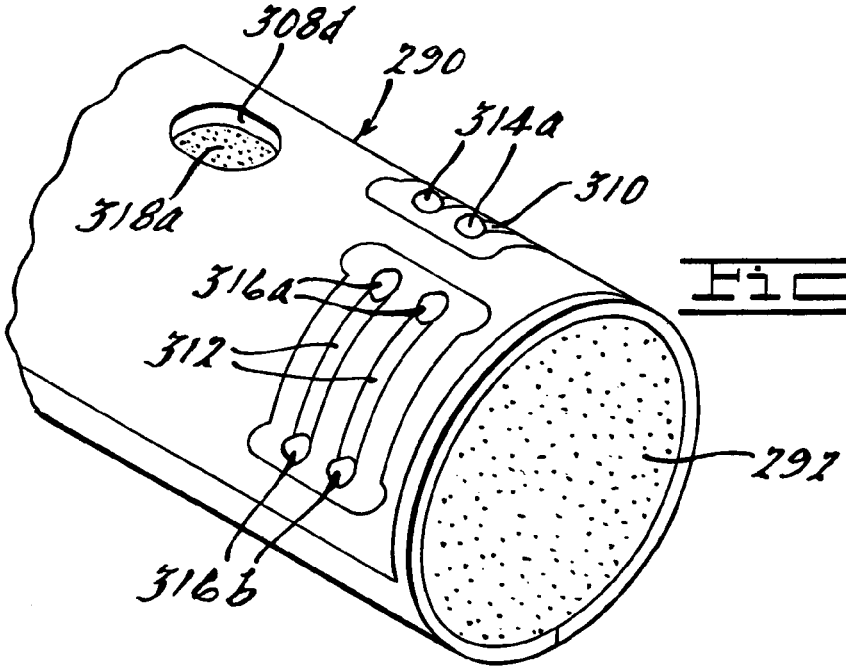
FIG. 25 is an enlarged perspective view of one end of a portion of the flexible connector assembly.

Referring to FIG. 25, the flexible circuit assembly 290 is shown wrapped over the compressible member 292. Preferably, the flexible electrical circuit 290 has an overall width that does not leave any overlaps. Hole 318*b* aligns with holes 308*a*, 308*c* while hole 318*a* aligns with openings 308*b*, 308*d*. Adhesive can be used to secure the flexible electrical circuit 290 to the compressible member 292, but may not be required. Pins 304*a* and 304*b* lock the flexible electrical circuit 290 into place by passing through all the holes 308.

Figure 27:
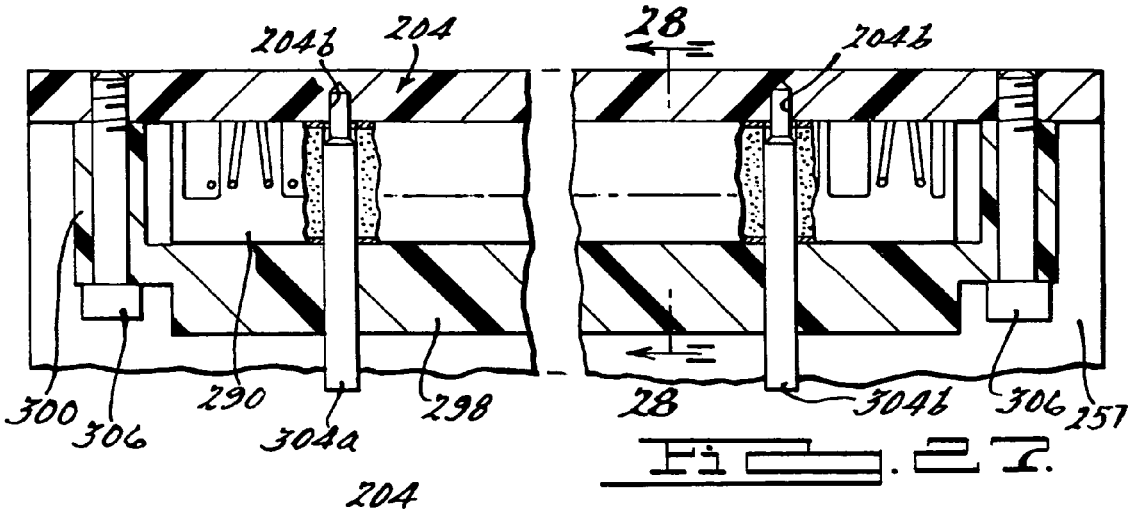
FIG. 27 is a cross sectional side view of the flexible connector assembly secured to the aperture board in accordance with section line 27—27 in FIG. 10.

Referring to FIG. 27, a highly enlarged, cross sectional side view in accordance with section lines 27—27 of FIG. 10 illustrates the compressible subassembly 294 in electrical contact with just the aperture board 204. A portion of the assembly 244 resides with the channel 257 in the module core 240.

Figure 28:
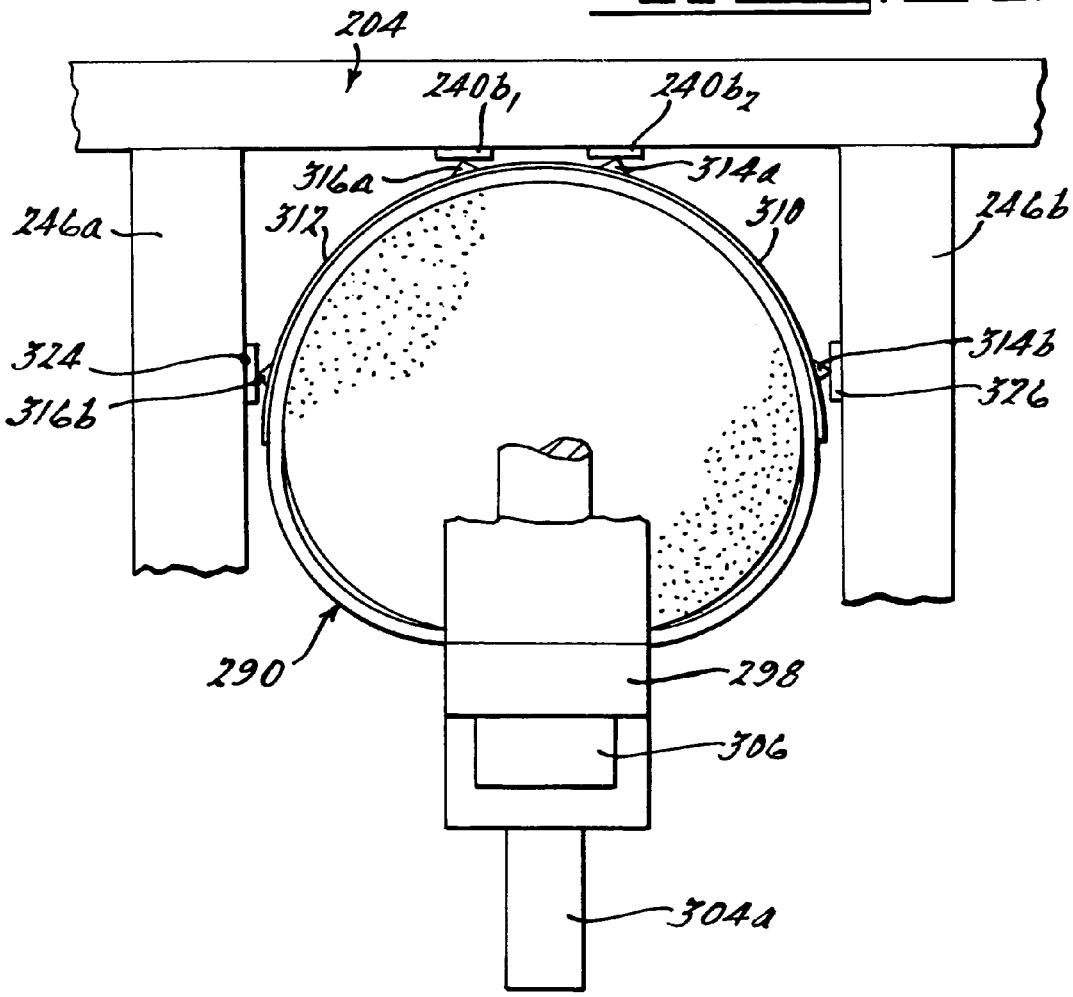
FIG. 28 is a cross sectional end view of the assembly taken in accordance with section line 28—28 in FIG. 27.

FIG. 28 is an enlarged, end, cross-sectional view of the flexible connector assembly 244 in accordance with section line 28—28 in FIG. 27, with the assembly 244 coupled to the aperture board 204 and the chip carrier boards 246*a* and 246*b*. The circuit traces 310 and 312 are shown in representative form making electrical contact with the chip carrier boards 246*a*, 246*b*. The aperture board 204 includes traces $\mathbf{240}b_1$, and $\mathbf{240}b_2$, also shown in highly simplified, representative form. Chip carrier board 246*a* includes a circuit trace 324 and board 246*b* includes at least one trace 326, where traces 324 and 326 are shown in simplified, representative form. The raised electrical contact pads 314*a* and 314*b* of trace 310 can be seen pressed into contact with the electrical traces $\mathbf{240}b_2$ and 326. Raised electrical contact pads 316*a*, 316*b* of circuit trace 312 are pressed into electrical contact with circuit traces $\mathbf{240}b_1$ and 324. The alignment pins 304*a* and 304*b*, in combination with the precisely located blind holes 204*b* (FIG. 25), provide highly accurate alignment of the raised electrical contact pads 314*a*, 314*b* and 316*a*, 316*b* relative to the electrical traces that they contact.

The precise dimensions of the raised contact pads 314, as well as the spacing between the circuit traces 310 and 312, can be tailored to accommodate a degree of misalignment of the raised contacts 314, 316. In one preferred form the raised contacts 314, 316 are formed in accordance with GoldDot™ flexible circuit technology available from Delphi Connection Systems of Irvine, Calif. The raised contacts 314, 316, in one exemplary form, have a base diameter of about 0.007 inch (0.18 mm) and a height of about 0.0035 inches (0.089 mm). Raised contacts could also be formed by drilling vias in the contact locations and barrel plating the vias in such a way that barrel of the via extends beyond the surface of the flexible electrical circuit 290 forming a raised contact. Alternately metallic bumps could be soldered or compression bonded onto the flexible electrical circuit 290.

Figure 29:
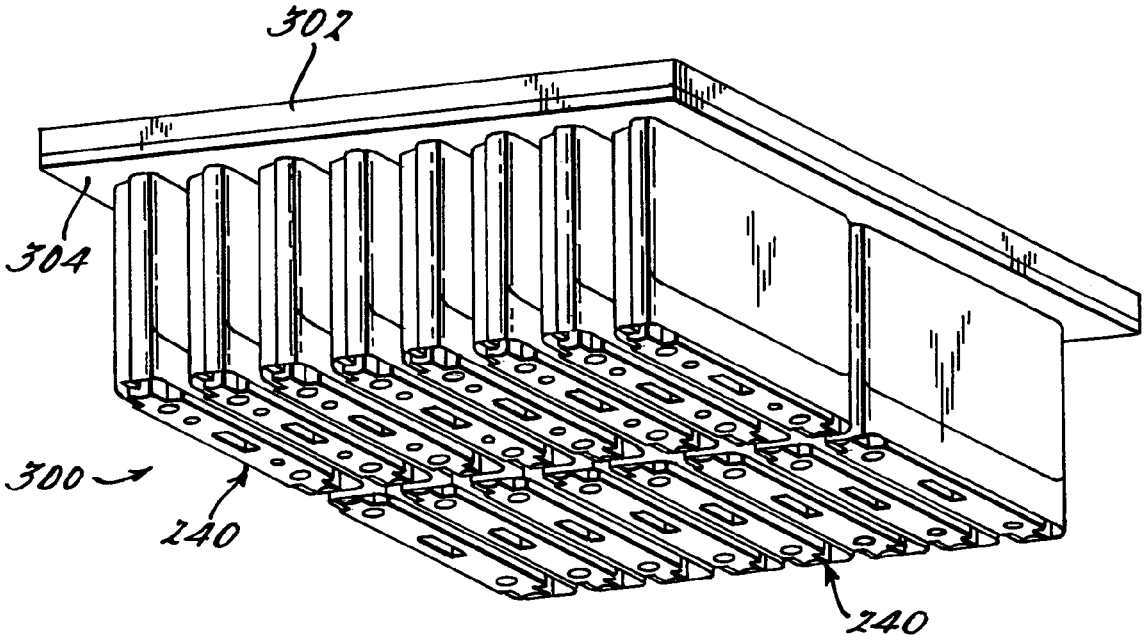
FIG. 29 is a perspective view of an antenna system incorporating a plurality of the chip carrier assemblies and module cores.

Referring to FIG. 29, a 256 element antenna aperture 300 incorporating sixteen of the modules 240 is illustrated. In a ganged embodiment, a suitably dimensioned honeycomb 302 having a plurality of 256 apertures (not visible) is disposed against an aperture board 304. Aperture board 304 includes 256 antenna components (not visible) that interface with the sixteen modules 240. Thus, apertures having $2^n$ (n being an integer) elements could be constructed to suit the needs of a wide range of applications. The systems 10 and 200 are ideally suited for phased array antenna applications where a large number (e.g., dozens, hundreds or thousands) of antenna electronics components must be coupled to a correspondingly large plurality of electromagnetic radiating elements in a relatively small area.

The antenna systems 10 and 200 that use distribution panels 14 and 18, and chip carrier assembly 242, provide ample room for the electronics required for a phased array antenna and enable the extremely tight radiating element spacing required for operation at V-band frequencies. The antenna systems 10 and 200 thus combine the advantages of previous "tile" type antenna architectures with those of the "brick" type architectures. The antenna systems 10 and 200 further include a module component that combines the use of a stripline waveguide with an air-filled waveguide to provide an antenna system with acceptable loss characteristics that still is able to distribute electromagnetic wave energy to a large plurality of tightly spaced radiating elements. This enables easy, modular expansion to create a larger overall antenna system. Additionally, the antenna systems 10 and 200 are readily suited for use with conventional waveguide distribution network components (e.g., a corporate waveguide component), thus making them especially well suited for use in larger (e.g., 128 element, 256 element, etc.) antenna systems. The system 200 is especially well suited to dissipating thermal energy generated by the chip carrier boards 246.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An antenna apparatus, comprising:

a module core having a waveguide input and an output, said input receiving electromagnetic wave energy fed into said waveguide input and directing said energy to said output;

an electromagnetic wave chip carrier component supported in thermal communication with said module core for receiving said electromagnetic wave energy and generating electrical signals;

said module core further operating to draw heat away from said chip carrier component; and a plurality of antenna radiating elements supported at an end of said module core opposite to that of said waveguide input and adjacent said chip carrier component for receiving said electrical signals and radiating electromagnetic wave signals.

2. The apparatus of claim 1, further comprising a heat sink in direct thermal communication with said module core for supporting said module core adjacent said waveguide input.

3. The apparatus of claim 1, further comprising a deformable electrical connector disposed adjacent said module core, said chip carrier component, and said plurality of radiating elements, for electrically coupling said chip carrier component and said antenna radiating elements.

4. The apparatus of claim 1, wherein said chip carrier component is physically and thermally adhered to said core.

5. An antenna apparatus comprising:

a metallic core structure having a waveguide input at a first end, a pair of output ports at an intermediate position and a waveguide splitter disposed between the output ports for dividing electromagnetic wave energy fed into said input through said output ports;

first and second chip carrier signal distribution panels for receiving portions of said electromagnetic wave energy from said output ports and generating first and second pluralities of electrical signals;

first and second groups of antenna radiating elements supported on said core structure at a second end of said core structure opposite to said first end; and a deformable electrical connector supported adjacent said signal distribution panels and said antenna radiating elements for electrically coupling said first signal distribution panels with said antenna radiating elements.

6. The apparatus of claim 5, wherein said deformable electrical connector is disposed between said signal distribution panels adjacent said second end of said core structure.

7. The apparatus of claim 5, wherein said deformable electrical connector includes a frame and a deformable elastomeric member, the frame securing the deformable elastomeric member adjacent said second end of said core structure.

8. The apparatus of claim 7, wherein said deformable electrical connector includes a plurality of circuit traces formed on a flexible substrate, the flexible substrate being secured to said deformable elastomeric member.

9. The apparatus of claim 5, further comprising a heat sink in thermal contact with said metallic core structure adjacent said first end.

10. An apparatus comprising:

a metallic core structure having a waveguide input at a first end, a pair of output ports at an intermediate position and a waveguide splitter disposed between the output ports for dividing electromagnetic wave energy fed into said input through said output ports;

first and second signal chip carrier distribution panels in thermal contact with said metallic core structure for receiving portions of said electromagnetic wave energy from said output ports and generating first and second pluralities of electrical signals;

a plurality of antenna radiating elements electrically coupled with said distribution panels and being supported on said core structure at a second end of said core structure opposite to said first end; and a heat sink thermally coupled to said first end of said core structure for dissipating heat generated by said distribution panels.

11. The apparatus of claim 10, further comprising a deformable electrical connector held adjacent edge portions of said signal distribution panels and in electrical contact with said distribution panels and said plurality of antenna radiating elements.

12. The apparatus of claim 11, wherein:

said plurality of antenna radiating elements is formed on a printed wiring board assembly; and wherein said deformable electrical connector includes a deformable member and a frame component, said frame component securing said deformable member in contact with said printed wiring board.

13. The apparatus of claim 12, wherein said frame component is secured to said printed wiring board and disposed between edge portions of said signal distribution panels.

14. The apparatus of claim 10, wherein said metallic core structure forms an unimpeded thermal path between said heat sink and each said distribution panel.

15. The apparatus of claim 10, wherein each of said signal distribution panels comprise a low temperature, co-fired ceramic (LTCC) panel that is adhered directly to surface portions of said metallic core structure.

16. A method for forming an antenna comprising:

using a metallic core structure having an internally formed waveguide for supporting at least one chip carrier signal distribution panel and for channeling electromagnetic wave energy fed into said waveguide to said signal distribution panel;

supporting a plurality of antenna radiating elements from said metallic core structure;

electrically coupling said antenna radiating elements with said signal distribution panel;

using said antenna radiating elements to radiate electromagnetic wave signals in accordance with output signals from said signal distribution panel; and using said metallic core as a heat sink to draw heat from said chip carrier signal distribution panel.

17. The method of claim 16, further comprising using the heat sink to cool said metallic core structure.

18. The method of claim 17, further comprising using a pair of signal distribution panels located on opposite sides of said metallic core structure, and a waveguide signal splitter formed in said metallic core structure to divide electromagnetic wave energy fed into said waveguide evenly to said pair of signal distribution panels.

19. The method of claim 18, further comprising supporting said metallic core structure directly on a surface of said heat sink.

20. The method of claim 16, further comprising using a deformable, cylindrical, elongated electrical connector to electrically couple said antenna radiating elements with said chip carrier signal distribution panel.

* * * * *